US005950473A

United States Patent [19]

Andrea et al.

[11] Patent Number: 5,950,473

[45] **Date of Patent: *Sep. 14, 1999**

[54] COIL SPRING FORMING AND CONVEYING ASSEMBLY

[75] Inventors: Michael E. Andrea, Kenosha, Wis.; Stuart C. Hamill, Grey Lynn Auckland, New Zealand; Wayne D. Jaworski, West Allis, Wis.; Horst F. Wentzek, Kenosha, Wis.

[73] Assignee: Frank L. Wells Company, Kenosha, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 09/005,346

[22] Filed: Jan. 9, 1998

Related U.S. Application Data

[60] Provisional application No. 60/057,213, Aug. 29, 1997.

[51] Int. Cl.[6] ..... B21F 3/12; B21C 47/00

[52] U.S. Cl. ..... 72/134; 140/3 CA; 140/92.7

[58] Field of Search ..... 72/134, 135; 140/3 CA, 140/92.3, 92.4, 92.6, 92.7, 92.8; 198/409, 448

[56] References Cited

U.S. PATENT DOCUMENTS

| | | | |
|---|---|---|---|
| 3,906,766 | 9/1975 | Sato | 72/12 |
| 4,014,371 | 3/1977 | Walker et al. | 140/3 |
| 4,413,659 | 11/1983 | Zangerle | 140/3 CA |
| 4,492,298 | 1/1985 | Zapletal et al. | 198/409 |
| 5,243,746 | 9/1993 | Shinichi | 29/173 |
| 5,477,893 | 12/1995 | Wentzek et al. | 140/101 |
| 5,579,810 | 12/1996 | Ramsey et al. | 140/3 CA |

FOREIGN PATENT DOCUMENTS

| | | | |
|---|---|---|---|
| 0 044 464 A2 | 1/1982 | European Pat. Off. | B21F 3/02 |
| 0 369 173 A2 | 5/1990 | European Pat. Off. | B21F 3/00 |
| 2 238 546 | 2/1975 | France | B21F 3/00 |
| 29 46 656 C2 | 10/1985 | Germany | B21F 3/06 |
| 43 23 009 A1 | 7/1992 | Germany | B21F 3/06 |

OTHER PUBLICATIONS

*Draht*, Jan. 1984, by Dr. H. Birkmann, pp. 18–21.

*Draht*, Sep. 1993, by Thomas Blum, Dietmar Sautter, Theo Tröster, pp. 504–514.

*Primary Examiner*—Joseph J. Hail, III

*Assistant Examiner*—Rodney Butler

*Attorney, Agent, or Firm*—Michael Best & Friedrich LLP

[57] ABSTRACT

Disclosed herein is a coil spring forming machine and transfer conveyor assembly comprising a transfer conveyor operable through a succession of operational cycles and including and endless conveyor assembly and a conveyor drive servo-motor drivingly connected to the conveyor assembly and operative, upon each energization thereof, to drive the conveyor assembly through one operational cycle. A control system operative to automatically and non-selectively cause energization of the conveyor drive servo-motor.

20 Claims, 11 Drawing Sheets

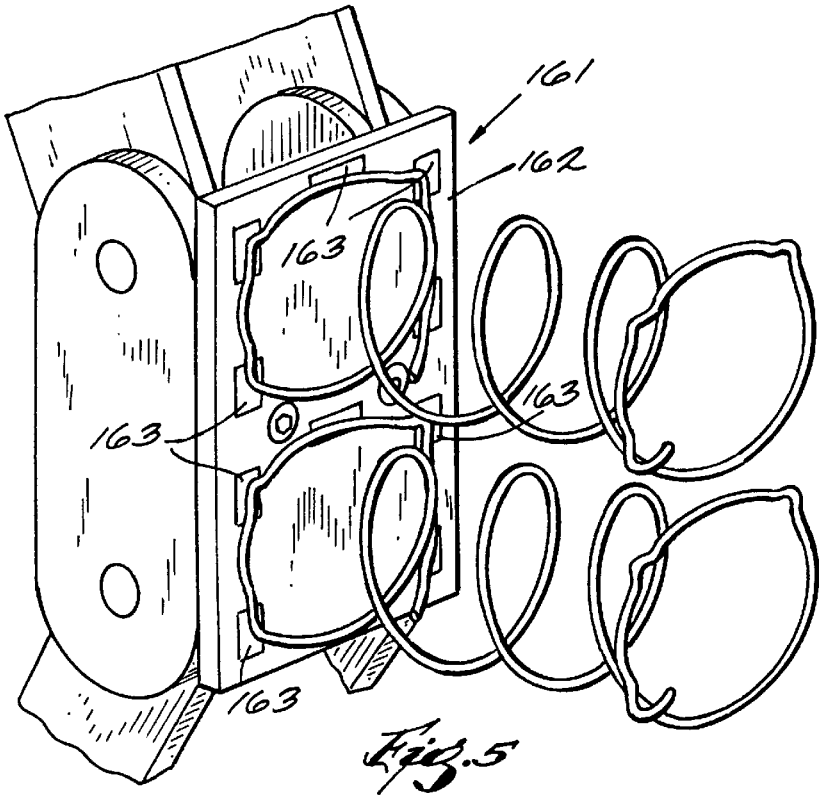
Fig. 5
Fig. 4
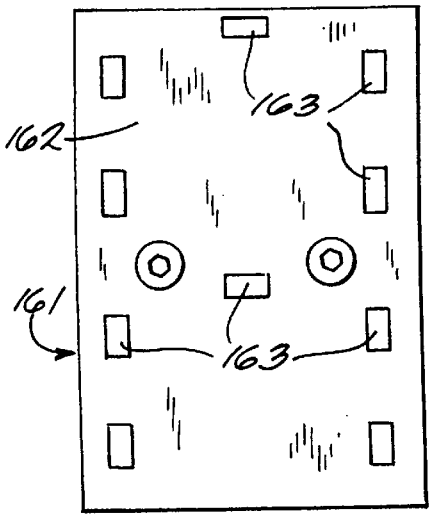
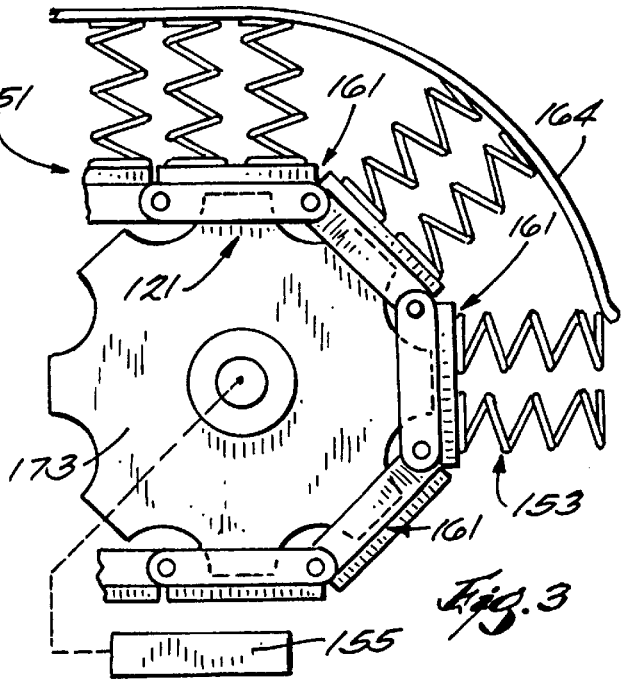
Fig. 3

COIL SPRING FORMING AND CONVEYING ASSEMBLY

RELATED APPLICATION

This application is a continuation-in-part of Provisional application Ser. No. 60/057,213, filed Aug. 29, 1997.

BACKGROUND OF THE INVENTION

The invention relates generally to machines for forming coil springs and delivering such coil springs to a coil spring assembling machine in which the coil springs are laced or otherwise connected together to form a coil spring assembly. In such combined machinery, a coil spring forming machine individually delivers the formed coiled springs to a transfer conveyor which, in turn, delivers the coil springs to a transfer apparatus which, in turn, delivers the coil springs to the coil spring assembling machine to form the coil spring assembly.

Attention is directed to the following U.S. Pat. Nos.:

4,413,659 (Zangerle) issued Nov. 8, 1983

4,492,298 (Zapletal et al.) issued Jan. 8, 1985

5,477,893 (Wentzek et al.) issued Dec. 26, 1995

5,579,810 (Ramsey et al.) issued Dec. 3, 1996

Attention is also directed to a prior brochure which is entitled "Announcing the World's Fastest, Most Advanced Pocket Spring Technology" and which was circulated by Elfex International Limited of Pickering, Ontario L1W1Z9 Canada.

SUMMARY OF THE INVENTION

The invention provides a coil spring forming machine and transfer conveyor assembly comprising a transfer conveyor operable through a succession of operational cycles and including an endless conveyor assembly arranged for periodic travel along a predetermined path and through a coil spring loading station, a conveyor servo-driving device drivingly connected to the conveyor assembly and operative, upon each energization thereof, to drive the conveyor assembly through one operational cycle thereof, a first coil spring forming machine located adjacent the predetermined path, operable through a succession of operational cycles to form coil springs, and, during a period of non-movement of the conveyor assembly, to load a coil spring on the conveyor assembly at the loading station, and including a first coil spring forming servo-driving device operative, upon each energization thereof, to drive the first coil spring forming machine through one operational cycle thereof, a second coil spring forming machine located adjacent the predetermined path, operable through a succession of operational cycles to form coil springs, and, during a period of non-movement of the conveyor assembly, to load a coil spring on the conveyor assembly at the loading station, and including a second coil spring forming servo-driving device operative, upon each energization thereof, to cause actuation of the second coil spring forming machine through one operational cycle thereof, and a control system operative to automatically and non-selectively cause energization of the conveyor servo-driving device in response to completion of one operational cycle of one of the first and second coil spring forming servo-driving devices, and operative to automatically and non-selectively cause energization of one of the first and second coil spring forming servo-driving devices in response to completion of one operational cycle of the conveyor servo-driving device.

The invention also provides a coil spring forming machine and transfer conveyor assembly comprising a transfer conveyor operable through a succession of operational cycles and including a single endless conveyor assembly arranged for periodic travel along a predetermined path and for passage through a coil spring loading station, and including a series of pallets which are successively located in the loading station incident to periodic travel of the conveyor assembly on the predetermined path, and a conveyor drive servo-motor drivingly connected to the conveyor assembly and operative, upon each energization thereof, to drive the conveyor assembly through one operational cycle thereof, a first coil spring forming machine located on one side of the predetermined path, operable through a succession of operational cycles to form a first coil spring, and, when one of the pallets is in the loading station and during a period of non-movement of the conveyor assembly, to load the first coil spring on the conveyor assembly in the loading station, and including a first coil spring forming servo-motor operative, upon each energization thereof, to drive the first coil spring forming machine through one operational cycle thereof, a second coil spring forming machine located on the other side of the predetermined path, operable through a succession of operational cycles to form a second coil spring, and, when the one pallet is in the loading station and during a period of non-movement of the conveyor assembly, to load the second coil spring on the conveyor assembly in the loading station, and including a second coil spring forming servo-motor operative, upon each energization thereof, to drive the second coil spring forming machine through one operational cycle thereof, and a control system operative to automatically and non-selectively cause energization of the conveyor drive servo-motor through one operational cycle in response to completion of one operational cycle of both of the first and second coil spring forming servo-motors, and operative to automatically and non-selectively cause simultaneous energization of the first and second coil spring forming servo-motors in response to completion of one operational cycle of the conveyor drive servo-motor.

The invention also provides a coil spring forming machine and transfer conveyor assembly comprising a transfer conveyor operable through a succession of operational cycles and including a single endless conveyor assembly arranged for periodic travel along a predetermined path and for passage through a coil spring loading station, and including a series of pallets which are successively located in the loading station incident to periodic travel of the conveyor assembly on the predetermined path, and which, when located in the loading station, extend vertically, and a conveyor drive servo-motor drivingly connected to the conveyor assembly and operative, upon each energization thereof, to drive the conveyor assembly through one operational cycle thereof, a first coil spring forming machine located on one side of the predetermined path, operable through a succession of operational cycles to form a first coil spring, and, when one of the pallets is in the loading station and during a period of non-movement of the conveyor assembly, to load the first coil spring on the conveyor assembly in the loading station, and including a first coil spring forming servo-motor operative, upon each energization thereof, to drive the first coil spring forming machine through one operational cycle thereof, a second coil spring forming machine located on the other side of the predetermined path, operable through a succession of operational cycles to form a second coil spring, and, when the one pallet is in the loading station and during a period of non-movement of the conveyor assembly, to load the second coil spring on the conveyor assembly in the loading station, and including a second coil spring forming servo-motor operative, upon each energization thereof, to drive the second coil spring forming machine through one operational cycle thereof, and a control system operative to automatically and non-selectively cause energization of the conveyor drive servo-motor through a first operational cycle in response to completion of one operational cycle of the first coil spring forming servo-motor, operative to automatically and non-selectively cause energization of the second coil spring forming servo-motor in response to completion of the first operational cycle of the conveyor drive servo-motor, operative to automatically and non-selectively cause energization of the conveyor drive servo-motor through a second operational cycle in response to completion of one operational cycle of the second coil spring forming servo-motor, and operative to automatically and non-selectively cause energization of the first coil spring forming servo-motor in response to completion of the second operational cycle of the conveyor drive servo-motor.

The invention also provides a coil spring forming machine and transfer conveyor assembly comprising a transfer conveyor operable through a succession of operational cycles and including an endless conveyor assembly arranged for periodic travel along a predetermined path and through a coil spring loading station and including a plurality of pivotally connected pallets each having a length which extends in the direction of conveyor assembly travel and which is approximately equal to a multiple of the diameter of the coil springs, and a conveyor drive servo-motor drivingly connected to the conveyor assembly and operative, upon each energization thereof, to drive the conveyor assembly through one operational cycle thereof, a coil spring forming machine located adjacent the predetermined path, operable through a succession of operational cycles to form a first coil spring, and, during a period of non-movement of the conveyor assembly, to load the first coil spring on the transfer conveyor, and including a coil spring forming servo-motor operative, upon each energization thereof, to drive the coil spring forming machine through one operational cycle thereof, and a control system operative to automatically and non-selectively cause energization of the conveyor drive servo-motor in response to completion of one operational cycle of the coil spring forming servo-motor, and, thereafter operative to automatically and non-selectively cause energization of the coil spring forming servo-motor in response to completion of one operational cycle of the conveyor drive servo-motor.

The invention also provides a coil spring forming machine and transfer conveyor assembly comprising a transfer conveyor operable through a succession of operational cycles and including an endless conveyor assembly arranged for periodic travel along a predetermined path and through a coil spring loading station, and a conveyor drive servo-motor drivingly connected to the conveyor assembly and operative, upon each energization thereof, to drive the conveyor assembly through one operational cycle thereof, a first coil spring forming machine located adjacent the predetermined path, operable through a succession of operational cycles to form coil springs, and, during a period of non-movement of the conveyor assembly, to load a coil spring on the transfer conveyor, and including a first coil spring forming servo-motor operative, upon each energization thereof, to drive the first coil spring forming machine through one operational cycle thereof, a second coil spring forming machine located adjacent the predetermined path, operable through a succession of operational cycles to form coil springs, and, during a period of non-movement of the conveyor assembly, to load a coil spring on the transfer conveyor, and including a second coil spring forming servo-motor operative, upon each energization thereof, to drive the second coil spring forming machine through one operational cycle thereof, and a control system including first and second counting and switching devices which are respectively connected to one of (a) the conveyor drive and (b) the first and second coil spring forming servo-motors, and which are respectively connectable to and disconnectable from the other of (a) the conveyor drive servo-motor, and (b) the first and second coil spring forming servo-motors, the first counting and switching device being adjustable to select a desired number of successive operational cycles of the first coil spring forming machine, being operable to effect the selected desired number of successive operational cycles of the first coil spring forming machine by successive energization of the first coil spring forming servo-motor in response to each successive completion of the selected desired number of operational cycles of the conveyor drive servo-motor, being operable, upon completion of the selected desired number of operational cycles of the conveyor drive servo-motor, to cause disconnection of the conveyor drive servo-motor and the first counting and switching device and connection of the conveyor drive servo-motor and the second counting and switching device, and the second counting and switching device being adjustable to select a desired number of successive operational cycles of the second coil spring forming machine, being operable to effect the selected desired number of successive operational cycles of the second coil spring forming machine by successive energization of the second coil spring forming servo-motor in response to each successive completion of the selected desired number of operational cycles of the conveyor drive servo-motor, being operable, upon completion of the selected desired number of operational cycles of the conveyor drive servo-motor, to cause disconnection of the conveyor drive servo-motor and the second counting and switching device and connection of the conveyor drive servo-motor and the first counting and switching device.

Other features and advantages of the invention will become apparent to those skilled in the art upon review of the following detailed description, claims and drawings.

DESCRIPTION OF THE DRAWINGS

FIG. 3 is an elevational view taken along line 3—3 of FIG. 2.

FIG. 4 is a plan view of the undersurface of one of the pallets included in the construction shown in FIG. 3.

FIG. 5 is an enlarged perspective view of the pallet shown in FIG. 4 with a coil spring located thereon when the pallet is in the coil spring loading station.

Figures 1, 2:
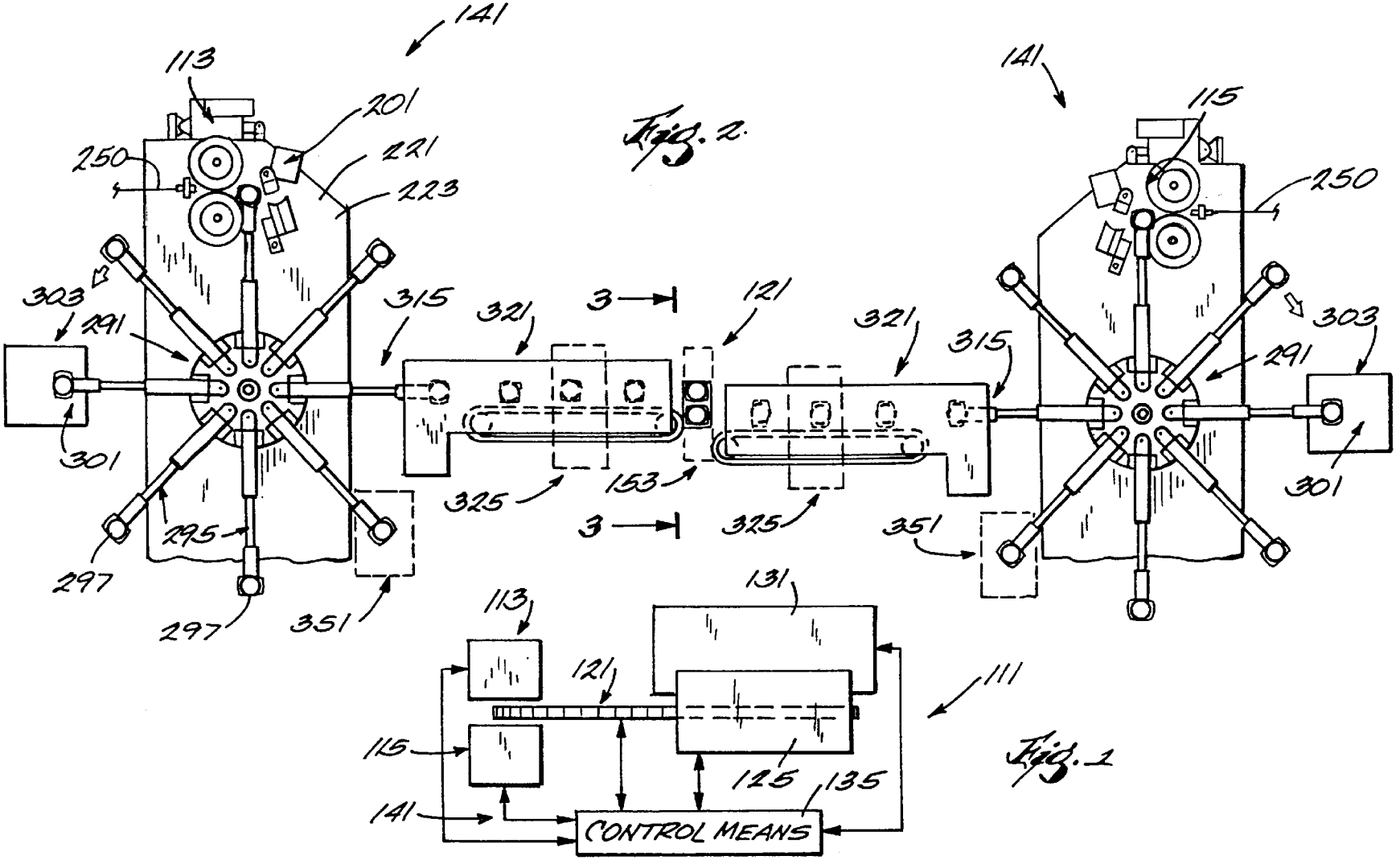
FIG. 1 is a schematic view of a coil spring forming and assembling machine which embodies various of the features of the invention.
FIG. 2 is a fragmentary end elevational view of one embodiment of a portion of the coil spring forming and assembling machine shown in FIG. 1.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

GENERAL DESCRIPTION OF THE INVENTION

Shown schematically in FIG. 1 of the drawings is a coil spring forming and assembling machine 111 including first and second coil spring forming machines 113 and 115 which form and deliver coil springs to a single, incrementally advancing transfer conveyor 121 which, in turn, delivers the coil springs to a coil spring transfer apparatus 125 which, in turn, delivers the coil springs to a coil spring assembly apparatus 131 which assembles the coil springs into a coil spring assembly.

The first and second coil spring forming machines 113 and 115 and the transfer conveyor 121 comprise an integrated coil spring forming machine and transfer conveyor assembly 141 in which the first and second coil spring forming machines 113 and 115 are respectively located on opposite sides of the transfer conveyor 121 for operation to simultaneously or alternately directly deliver fully formed (and tempered) coil springs to the single transfer conveyor 121. The coil spring forming and assembling machine 111 also includes a control system 135 in which operation of the coil spring forming machine(s) 113 and 115 are dependent on completion of the incremental advancement of the transfer conveyor 121, and in which operation of the transfer conveyor 121 is dependent on completion, and delivery, of a fully completed coil spring by one or both of the coil spring forming machine(s) 113 and 115.

More particularly, the transfer conveyor 121 includes (see FIG. 3) an endless conveyor chain or assembly 151 arranged for periodic or incremental travel along a predetermined path and through a coil spring loading station 153, and a (schematically illustrated) servo-operated driving motor or other device 155 which is suitably mounted on the transfer conveyor 121 and which is operatively connected to the transfer conveyor chain or assembly 151 for periodically or incrementally driving the transfer conveyor chain or assembly 151 on the predetermined path and through a series of incremental advances which are all of the same length. Any suitable servo-operated driving device, including a linear servo-motor, can be employed and, in the disclosed construction, a commercially available conveyor drive servo-motor 155 is employed.

The endless conveyor chain or assembly 151 includes a series of pivotally connected pallets 161 which are successively located in the loading station 153 incident to periodic or incremental travel of the transfer conveyor chain or assembly 151 on the predetermined path.

The pallets 161 can take various forms. In one embodiment shown in FIGS. 4 and 5, the pallets 161 are of generally identical construction, have a generally flat outer surface 162 adapted to receive one of the terminal end coils of a coil spring, and are generally rectangular in shape, having a length which, in the direction of travel of the transfer conveyor 121, is substantially equal to or slightly more than the major or largest diameter of two coil springs standing side-by-side. Each pallet 161 also includes one or more magnets 163 which are operative to hold the coil springs in place on the pallets 161 during advancement of the transfer conveyor 121. More particularly, in the specifically disclosed construction, each pallet 161 includes, on the outer surface thereof, a plurality of permanent magnets 163. Any suitable magnet construction can be employed.

Thus, as shown in FIG. 5, the bottom terminal convolution of the coil springs are magnetically held by the pallets 161 and the upper terminal convolutions thereof come into engagement (see FIG. 3) with a stationary compression bar 164 as the transfer conveyor 121 advances the coil springs away from the loading station 153.

The pallets 161 can be directly pivotally connected to each other or, alternatively, the pallets 161 can be suitably mounted on, or carried by, a commercial chain. In the specific construction shown in FIG. 3, the pallets are mounted on a commercially obtainable chain.

Figure 10:
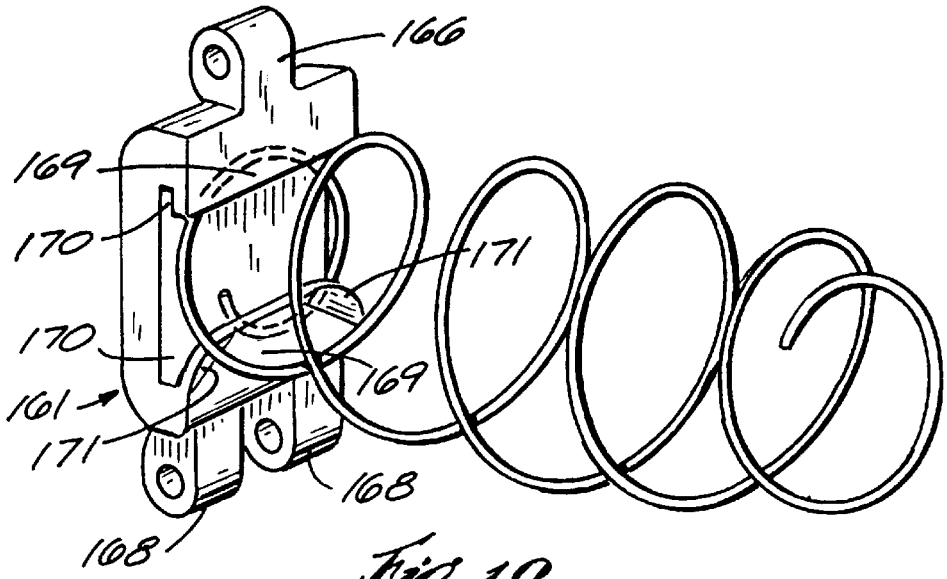
FIG. 10 is an enlarged perspective view of the pallet shown in FIGS. 8 and 9 with a coil spring located thereon when the pallet is in the coil spring loading station.
Figure 9:
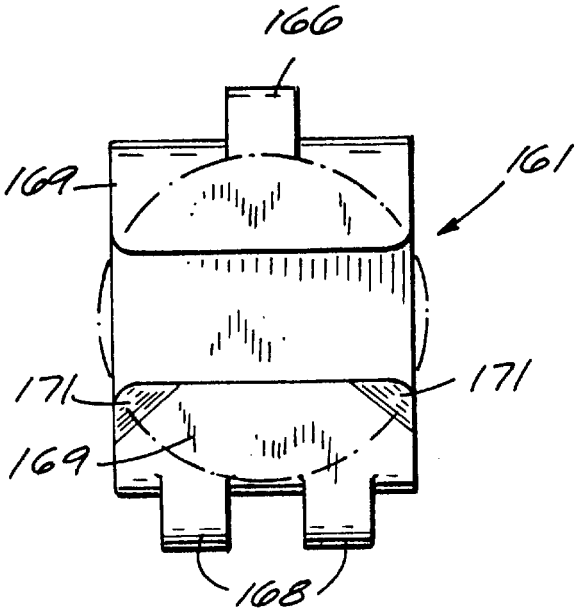
FIG. 9 is a top plan view of the pallet shown in FIG. 8.
Figure 8:
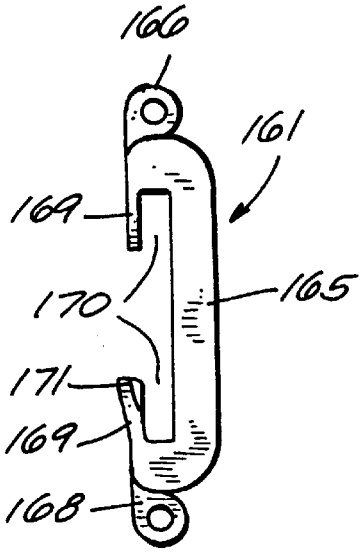
FIG. 8 is a side elevational view of one of the pallets included in the construction shown in FIG. 7.

Shown in FIGS. 8, 9, and 10, is another pallet construction in which each of the pallets 161 includes a lower generally rectangular base web 165 which has a lower generally flat surface. At one longitudinal end thereof, each of the pallets 161 includes a central ear 166 having a transverse bore adapted to accept a hinge pin (not shown) of suitable construction. At the other longitudinal end thereof, each of the pallets 161 includes a pair of transversely spaced ears 168 which receive therebetween the central ear 166 of an adjacent one of the pallets 161 and which include respective bores adapted to receive the just-mentioned hinge pin located in the central ear 166 of the adjacent one of the pallets 161.

The pallets 161 shown in FIGS. 8, 9, and 10 also include, adjacent each end, respective tabs 169 which extend toward each other in spaced relation to the base web 165 and which, in cooperation with the base web 165, define sockets or pockets 170 which are open on each side so to accommodate loading of the pallets 161 with coil springs from either side. The tab 169 at the other end, i.e., the end having the spaced ears 168, also includes, adjacent each of the sides, respective upwardly extending generally triangular wing portions 171. Accordingly, during coil spring loading, the pallet 161 is arranged to laterally receive one end coil or convolution of each coil spring to be transported. In this regard, the wing portions 171 accommodate the initial axial curve of the wire from the end coil.

In addition, the transfer conveyor 121 also includes a drive wheel or pulley 173 which is periodically and incrementally driven about a horizontal axis and relative to the coil spring loading station 153 by the conveyor drive servo-motor 155, and a wheel member or pulley (not shown) which is spaced from the drive wheel 173 and which is periodically and incrementally rotatably moveable about a fixed horizontal axis. The endless transfer conveyor chain or assembly 151 is partially trained around the drive wheel 173 and the wheel member for periodic and incremental travel along the predetermined path and through the coil spring loading station 153.

In operation, the pallets 161 are successively located in the loading station 153 incident to incremental travel or advancement of the transfer conveyor chain or assembly 151 on the predetermined path, with each such incremental advance occurring in response to each energization of the conveyor drive servo-motor 155 and being of the same length. Consequently, each incremental advance of the transfer conveyor chain or assembly 151 is approximately the length of the pallets 161. While the endless conveyor chain or assembly 151 is disclosed above as being periodically and incrementally advanced by the drive wheel 173 which, in turn, is driven by the conveyor drive servo-motor 155, if desired, the wheel member (not shown) could be driven by the conveyor drive servo-motor 155 instead of the drive wheel or pulley 173 or any other arrangement could be employed for incrementally advancing the transfer conveyor chain or assembly 151 incident to each energization of the conveyor drive servo-motor 155.

The first coil spring forming machine 113 includes (as shown in FIG. 2) a (schematically illustrated) servo-operated main forming machine driving motor or other device 225 which is suitably mounted on the first coil spring forming machine 113 and which is operative, upon each energization thereof, to cause actuation of the first coil spring forming machine 113 through one operational cycle thereof. Any suitable servo-operated driving device, including a linear servo-motor, can be employed and, in the disclosed construction, a first commercially available main forming machine drive servo-motor 225 is employed.

Figure 12:
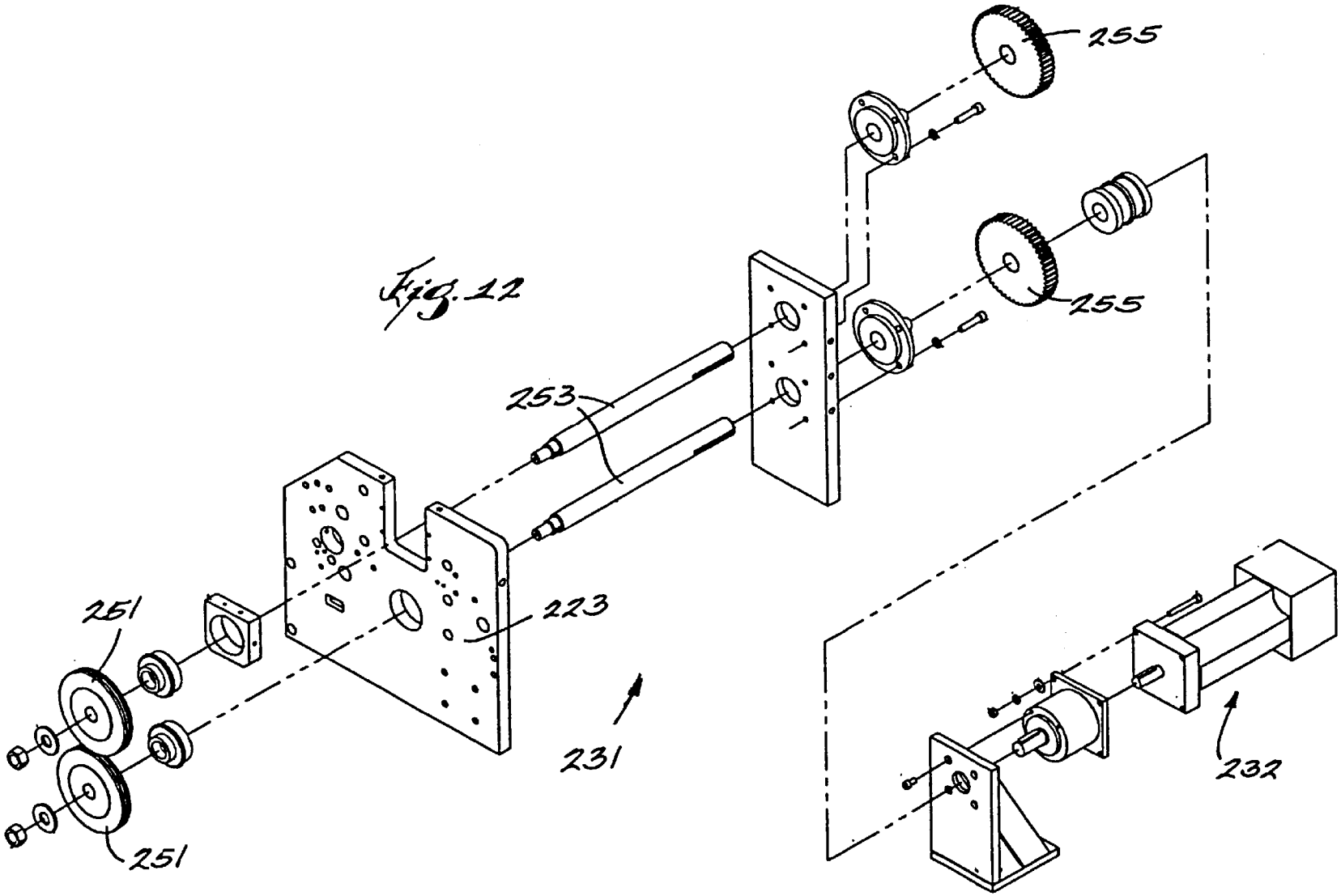
FIG. 12 is an exploded view of a wire feed advancing mechanism included in the coil spring forming and assembling machine shown in FIG. 11.

The servo-operated main forming machine drive device 225 controls energization of a wire feed advancing mechanism 231 (see FIG. 12), a pitch control mechanism 235 (see FIG. 13), and a diameter control mechanism 243 (see FIG. 14), (all still to be described) and specifically drives or powers a spoke assembly 291 and a delivery mechanism or conveyor 321 (all still to be described), all of which are part of the coil spring forming machine 113.

The first coil spring forming machine 113 also includes a first coil spring forming head 201 which is periodically operative to successively at least partially form coil springs.

In addition, the first coil spring forming machine 113 operates, when one of the pallets 161 is in the loading station 153 and during a period of non-movement of the conveyor chain or assembly 151, to deliver or load a fully or completed formed (and tempered) coil spring on the one of the pallets 161 located in the loading station 153.

Except for being located on the opposite side of the transfer conveyor 121 from the first coil forming machine 113 and except for preferably being of the opposite hand, i.e., being left-handed instead of being right-handed, the second coil spring forming machine 115 is generally of identical construction to the first coil spring forming machine 113, could be of the same hand, and includes a (schematically illustrated) second servo-operated main forming machine driving motor or other device 226 which is suitably mounted on the second coil spring forming machine 115 and which is operative, upon each energization thereof, to cause actuation of the second coil spring forming machine 115 through one operational cycle thereof. Any suitable servo-operated driving device, including a linear servo-motor, can be employed and, in the disclosed construction, a second commercially available main forming machine drive servo-motor (226) is employed.

The second main forming machine drive servo-motor 226 controls energization (with respect to the second coil spring forming machine 115) of a wire feed advancing mechanism 231, a pitch control mechanism 235, and a diameter control mechanism 243, (all still to be described) and specifically drives or powers a spoke assembly 291 and a delivery mechanism or conveyor 321 (all still to be described), all of which are part of the coil spring forming machine 115.

In addition, the second coil spring forming machine 115 also includes a second coil spring forming head 211 which is periodically operative to successively at least partially form coil springs. Still further in addition, the second coil spring forming head 211 operates, when the one of the pallets 161 is in the loading station 153 and during a period of non-movement of the conveyor chain or assembly 151, to load a fully or completely formed (and tempered) coil spring on the one of the pallets 161 located in the loading station 153.

In an alternative embodiment, as will be disclosed, the second coil forming machine 115 can be operative to periodically form coil spring and, when the next one of the pallets 161 is in the loading station 153 and during the next period of non-movement of the conveyor chain or assembly 151, to load a completed or fully formed (and tempered) coil spring on the next one of the pallets 161.

Because the first and second coil spring forming machines 113 and 115 are generally identically constructed, only the first coil spring forming machine 113 will be further described. In this regard, the first servo-operated main forming machine drive motor or other device 225 (and the second servo-operated main forming machine drive motor 226) can take any suitable form, including a linear servo-motor, and in the disclosed construction, is preferably in the form of a commercially available servo-motor which is suitably mounted on the associated one of the coil spring forming machines 113 and 115.

Because the first and second coil spring forming heads 201 and 211 are also of the same construction, except for being left- and right-handed, only the coil spring forming head 201 will be described. In this regard, the coil spring forming head 201, as shown best in FIGS. 2 and 11 through 14, is operative successively to at least partially form a series of generally identical coil springs which can be either knotted or unknotted coil, and includes a frame 221 including a generally vertically extending frame member 223.

Further in this regard, the first coil spring forming head 201 includes (see FIG. 12) a wire feed advancing mechanism 231 which is driven by a a servo-operated driving motor or other device 232 which is suitably mounted in the frame 221 and which is operative or energized in response to operation of the main forming machine drive servo-motor 225 (or 226). The servo-operated driving motor or other device 232 can take any suitable form, including a linear servo-motor, and in the disclosed construction, is preferably in the form of a commercially available wire feed servo-motor (232).

In addition, the first coil spring forming head 201 also includes (see FIG. 13) a pitch control mechanism 233 including a pitch control tool 235 and a servo-operated driving motor or other device 239 which is suitably mounted on the frame 221, which is drivingly connected to the pitch control tool 235, and which is operative, in response to each operation of the wire feed servo driving motor or other device 232, to drive or locate the pitch control tool 235. The just-mentioned pitch control servo-operated driving motor or other device 239 can take any suitable form, including a linear servo-motor, and in the disclosed construction, is preferably in the form of a commercially available pitch control servo-motor 239.

Still further in addition, the first coil spring forming head 201 also includes (see FIG. 14) a diameter control mechanism 243 including a diameter control tool 245 and a servo-operated driving motor or other device 249 which is suitably mounted on the frame 221, which is drivingly connected to the diameter control tool 245, and which is operative, in response to each operation of the wire feed servo-motor 232, to drive or locate the diameter control tool 245. The servo-operated driving motor or other device 249 can take any suitable form, including a linear servo-motor, and in the disclosed construction, is preferably in the form of a commercially available diameter control servo-motor (249).

The wire feed advancing mechanism 231 can be of any suitable construction and, in the specifically disclosed construction, the wire feed advancing mechanism 231 includes (see FIGS. 11 and 12) a pair of feed rollers 251 which are operative to incrementally advance a wire 250 from which the coil springs are formed. The feed rollers 251 are respectively mounted on a pair of drive shafts 253 which are respectively rotatably supported by bearings fixedly supported by the frame member 223 and which are respectively fixed to, and rotatably driven by, a pair of meshing gears 255. One of the meshing gears 255 is rotatively driven by the wire feed drive servo-motor 232 which is fixedly mounted on the frame 221.

The pitch control tool mechanism 233, including the pitch control tool 235, can also be of any suitable construction.

Figure 13:
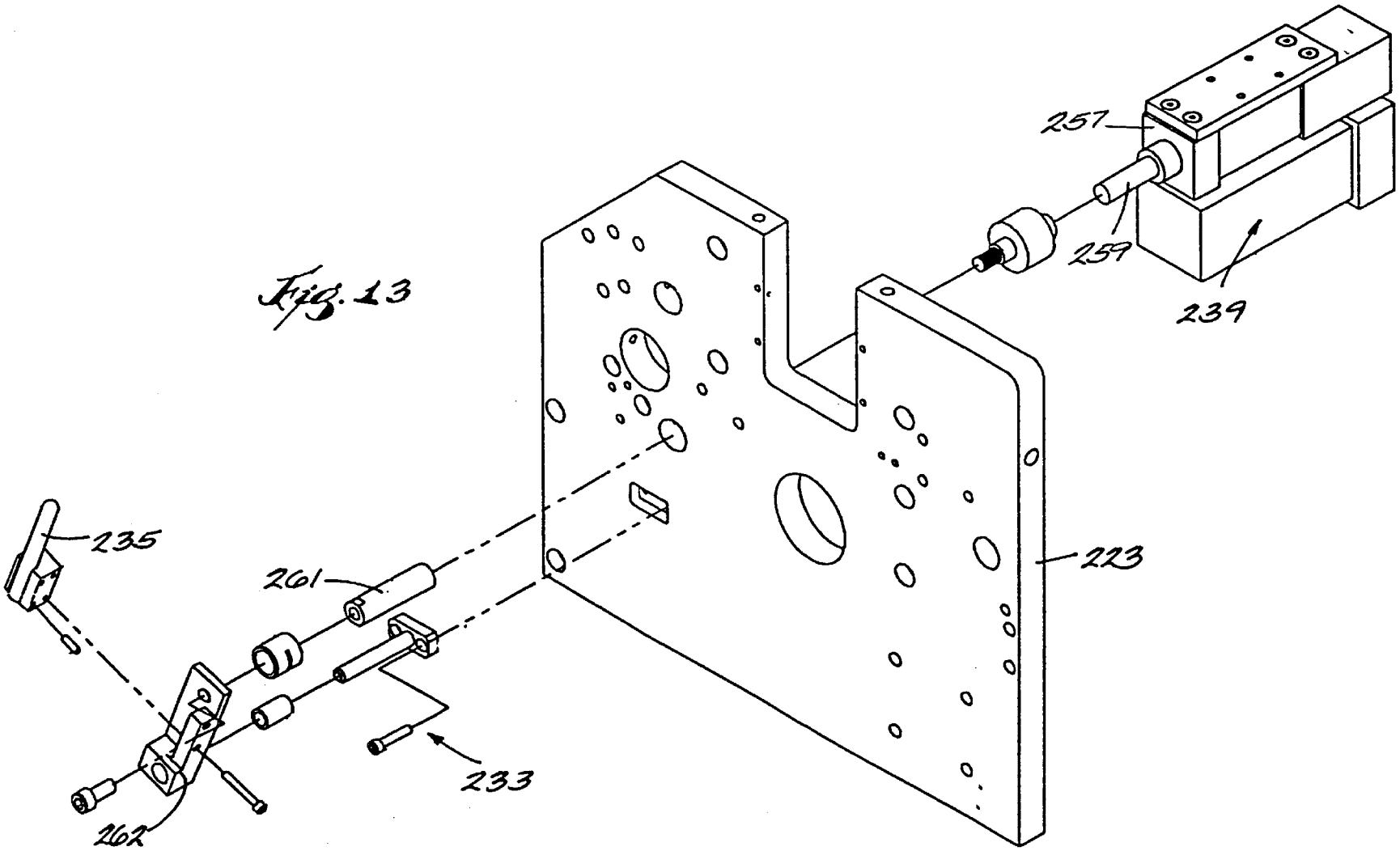
FIG. 13 is an exploded view of a pitch control mechanism included in the coil spring forming and assembling machine shown in FIG. 11.

Various constructions can be employed to drivingly connect the pitch control tool 235 to the pitch control servo-motor 239. In the preferred and specifically disclosed construction, (as shown in FIG. 13) the pitch control servo-motor 239 is fixedly mounted on the frame 221 and is connected by a suitable ballscrew mechanism 257 to an output member 259 so as to convert the rotary output of the pitch control servo-motor 239 into axial translatory movement of the output member 259. As shown in the drawings, the output member 259 passes through a bearing supported in the frame member 223 and includes an outer end 261 having mounted thereon a pitch control tool holder 262 to which the pitch control tool 235 is fixed. The pitch control tool holder 262 and the pitch control tool 235 have common movement with the output member 259 incident to operation of the pitch control servo-motor 239. The pitch control tool 235 engages the wire 250 during coil spring formation to effect the desired coil spring pitch.

The diameter control mechanism 243, including the diameter control tool 245, can also be of any suitable construction.

Figure 11:
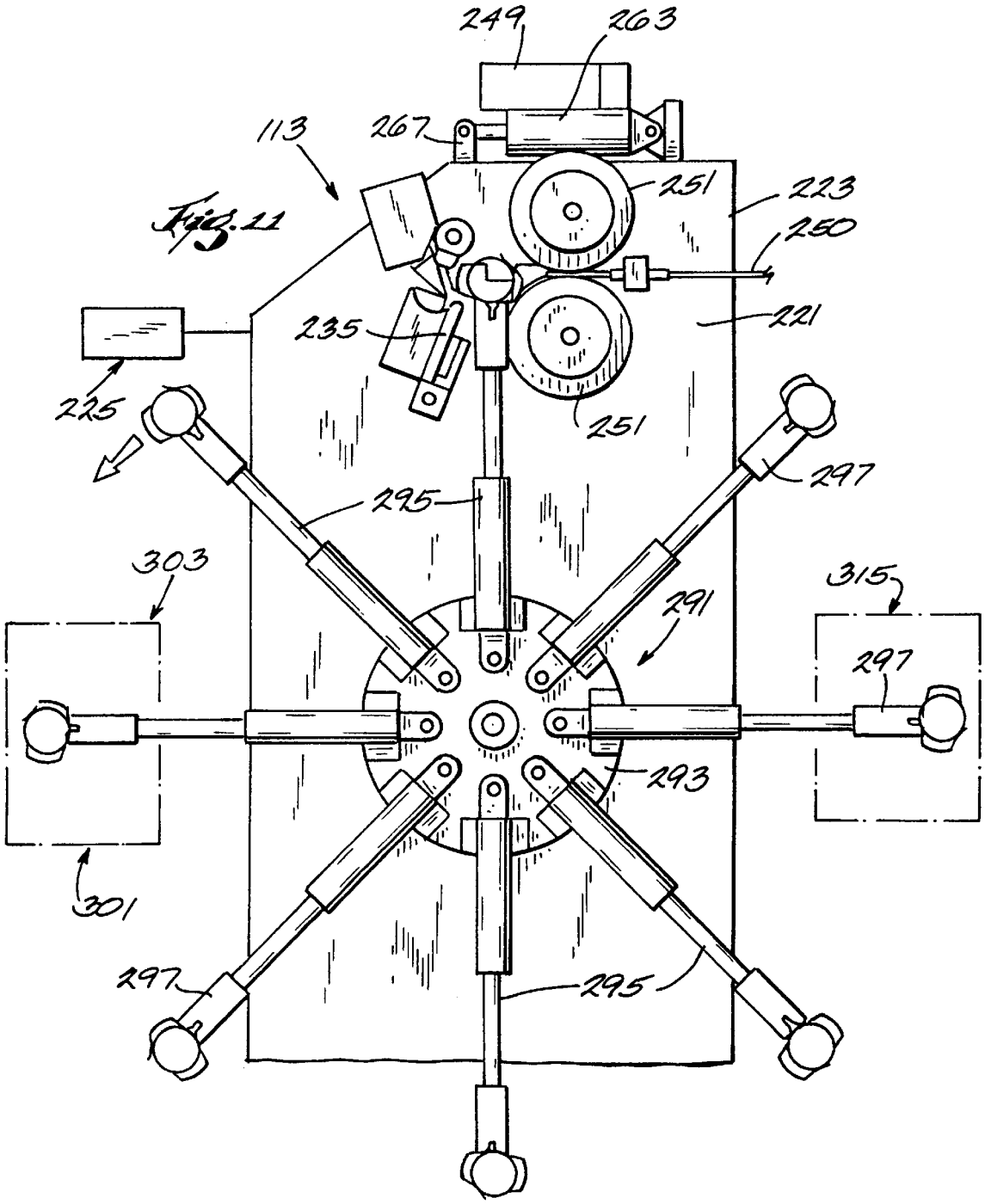
FIG. 11 is an enlarged view of one of the coil spring forming machines included in the coil spring forming and assembling machine shown in FIG. 1.
Figures 14, 15:
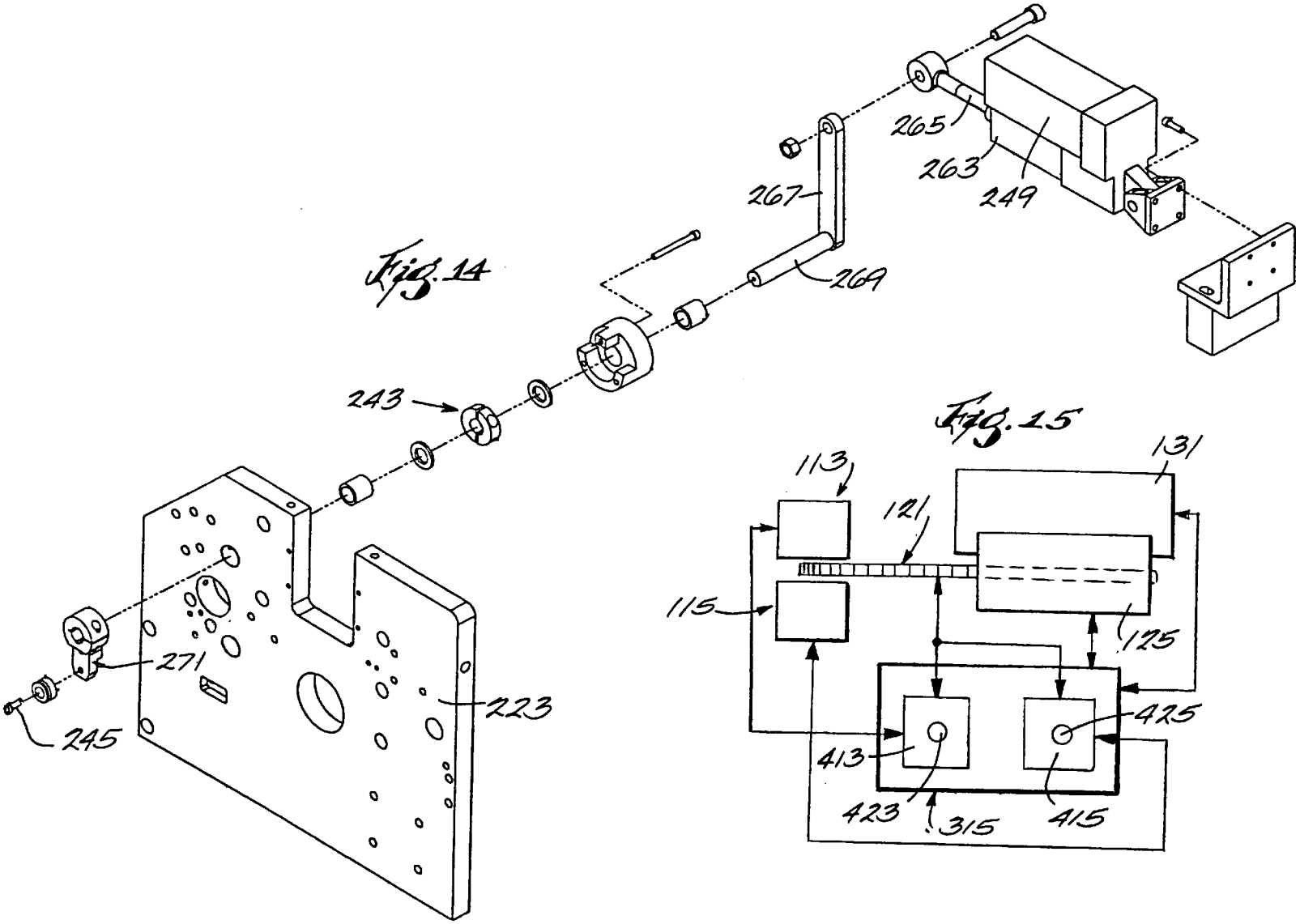
FIG. 14 is an exploded view of a diameter control mechanism included in the coil spring forming and assembling machine shown in FIG. 11.
FIG. 15 is a schematic view of another embodiment of a coil spring forming and assembling machine which embodies various of the features of the invention.

Various constructions can be employed to drivingly connect the diameter control tool 245 to the diameter control servo-motor 249. In the preferred and specifically disclosed construction, (as shown in FIGS. 11 and 14) the diameter control servo-motor 249 is pivotally mounted on the frame 221 and is connected by a suitable ballscrew mechanism 263 to an output member 265 so as to convert the rotary output of the diameter control servo-motor 249 into axial translatory movement of the output member 265. As shown in the drawings, at the outer end thereof, the output member 265 is pivotally connected to one end of a lever 267 which, at the other end thereof, is fixedly connected to a shaft member 269 which passes through a bearing fixedly supported by the frame member 223 and which, at the outer end thereof, includes a radially outwardly extending diameter control finger 271 which pivots about the axis of the shaft member 269 incident to axial translatory movement of the output member 265 driven by the diameter control servo-motor 249. At the outer end thereof, the diameter control finger 271 includes the diameter control tool 245 which engages the wire 250.

Both the pitch control servo-motor 239 and the diameter control servo-motor 249 are dependent upon, and are operated or energized in response to, energization of the wire feed servo-motor 232. However, the operation of the pitch control servo-motor 239 and the diameter control servo-motor 249 can be varied by suitable controls in order to vary the pitch and diameter of the coil springs being formed. Notwithstanding, and to repeat, the pitch control servo-motor 239 and the diameter control servo-motor 249 operate only in response to, and during the operation of, the wire feed servo-motor 232.

The first coil forming machine 113 also includes (as shown in FIG. 11) a rotating spoke assembly 291 which is of known construction, which is rotatably mounted on the frame 221, and which includes a hub 293, and a plurality of spokes or arms 295 which extend from the hub 293 and which respectively include, at the outer end thereof, a releasable gripping mechanism 297.

The spoke assembly 291 is incrementally rotatably driven by the main forming machine drive servo-motor 225 in such manner as to serially locate one of the spokes 295 and associated gripping mechanism 297 in position to grasp a partially formed coil spring as the partially formed coil spring exits the coil forming head 201. Thereafter, the spoke assembly 291 incrementally rotates in response to each succeeding energization of the main forming machine drive servo-motor 225 so as to first move the gripped coil spring to a bending or other work station 301. At the bending or other work station 301, the axially spaced terminal coils or ends of the coil spring are further formed by suitable, schematically illustrated, wire forming mechanism(s) 303 which are of known construction and which are supported by the frame 221 at the bending or other work station 301. The wire forming mechanism(s) 303 are utilized to further form the partially formed coil springs by performing such operations as bending, knotting, crimping, or any other further formation of the coil spring ends. The wire forming mechanism(s) 303 can be driven by any suitable arrangement, including a servo-operated drive motor(s) or other device(s) (not shown) which, preferably, can be in the form of a commercially available servo-motor(s) which is/are mounted on the frame 221.

Thereafter, the spoke assembly 291 again incrementally rotates to move the gripped coil spring so as to serially deliver the partially formed coil spring to a transfer station 315 wherein the gripped coil spring is released and is contacted (see FIG. 2) by a delivery mechanism or conveyor 321 which is part of the first coil spring forming machine 113, which is powered by the main forming machine drive servo-motor 225, and which can be of any suitable construction.

In the construction shown in FIG. 2, the delivery mechanism or conveyor 321 includes a schematically illustrated apparatus 325 which is operative (if formation of the coil spring was not completed by the wire forming mechanism(s) 303) to complete the forming of the coil springs by finally bending the ends of the axially spaced terminal coils and which is operative to temper the coil springs during travel therealong to the transfer conveyor 121 at the coil spring loading station 153. Any suitable final bending and coil spring tempering apparatus can be employed, such as the apparatus disclosed in New Zealand patent application Ser. No. 08/964,259, filed May 27, 1996, and entitled "Spring Formation".

The delivery mechanism or conveyor 321 is arranged to deliver the fully formed and tempered coil springs to the pallets 161 of the transfer conveyor 121 when, as already noted, the pallets 161 are located in a vertical disposition or orientation.

The delivery mechanism or conveyor 321 can also include a mechanism (not shown) for angularly orientating the coil spring ends so that, upon delivery of the coil springs to the transfer conveyor 121, the coil spring ends will be properly orientated on the transfer conveyor 121.

In the embodiment shown in FIG. 2, as will be more fully disclosed hereinafter, the coil spring forming machines 113 and 115 simultaneously deliver coil springs to the transfer conveyor 121 so that the coil springs are located in side-by-side relation in the direction of travel of the transfer conveyor 121. In this regard, the delivery mechanism or conveyor 321 of one of the coil spring forming machines 113 and 115 is located vertically (as shown in FIG. 2) so as to deliver coil springs to the upper half of the pallet 161 which extends vertically in the loading station 153. The other of the coil spring forming machines 113 and 115 is located or arranged so that the delivery mechanism or 321 is at a lower vertical location so as to deliver coil springs to the lower half of the same pallet in the loading station 153.

Figure 7:
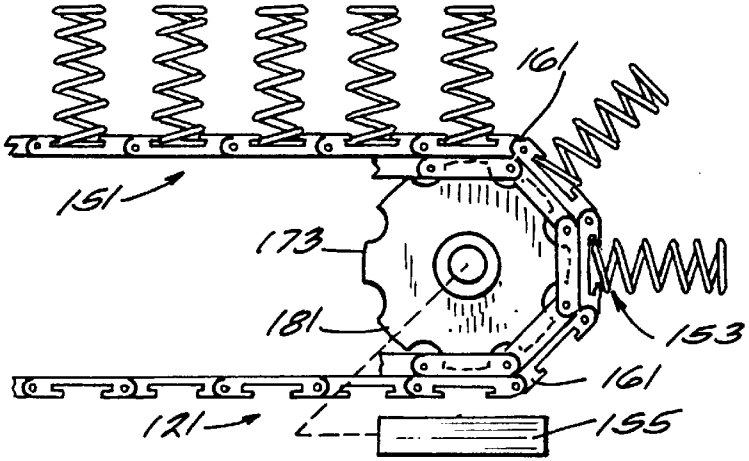
FIG. 7 is an elevational view taken along line 7—7 of FIG. 6.

In the embodiment shown in FIG. 7, as will be more fully disclosed hereinafter, the coil spring forming machines 113 and 115 alternately deliver coil springs to the transfer conveyor 121. More specifically, one of the coil spring forming machines 113 and 115 is operative to deliver a coil spring to the pallet 161 which extends vertically in the loading station 153 and then, after an incremental advancement of the transfer conveyor 121, the other one of the coil spring forming machines 113 and 115 is operative to deliver a coil spring to the next pallet 161 which is then vertically located in the loading station 153.

Alternatively, if desired, the coil spring forming machine (s) 113 and 115 can be arranged to temper the coil springs by a suitable tempering mechanism 351 located at a tempering station situated along the path of the spoke assembly 291 and during the dwell of the spoke assembly 291 between energizations of the main forming machine drive servo-motor 255. Also, if desired, the coil spring forming machine (s) 113 and 115 can be located so as to enable the spoke assembly 291 to directly and serially deliver fully formed and tempered coil springs to the transfer conveyor 121, without employing the delivery mechanism or conveyor 321 described above.

In another alternative construction, a linearly operating transport device or mechanism (not shown) can be employed (in place of the spoke assembly 291) between a coil spring forming head and the loading station 153 associated with the transfer conveyor 121. More specifically, in this construction, the transport mechanism (not shown) serves to linearly carry a partially formed coil spring from a suitable coil spring forming head to a first or coil spring bending or knotting station (which includes a suitable mechanism for bending or knotting), and, simultaneously, to carry the previously formed coil spring from the first station to a second or tempering station (including a suitable tempering device). Thereafter, the tempered coil spring can be delivered to the loading station 153 by another coil spring conveying device. In general, any suitable construction can be employed for transporting coil springs from the coil spring forming heads to the loading station 153 of the transfer conveyor 121.

The coil spring forming and assembling machine 111 also includes the before-mentioned control means or system 135 which coordinates the operation of the coil spring forming machine(s) 113 and 115 and the transfer conveyor 121 (as well as the transfer apparatus 125 and the assembly apparatus 131). In response to operation of the control system 135, one operational cycle of the conveyor drive servo-motor 155 causes one incremental advance of the transfer conveyor 121. Upon completion of such incremental conveyor assembly advance, the first and second main forming machine drive servo-motors 225 and 226 are energized to cause advancement by the wire feed servo-motor 232 of the wire 250 through the coil forming head 201, thereby partially forming a coil spring by the associated coil forming head 201, to cause one increment of rotation of the associated spoke assembly 291 by the associated main forming machine drive servo-motor 225 or 226, to cause one operation of the bending mechanism 303, to cause one operation of the tempering mechanism 351 (if included), and to cause delivery of one fully completed and tempered coil spring by the delivery mechanism 321 to the transfer conveyor 121. In normal operation, the main forming machine drive servo-motor 225 is actuated several times, in respective response to an equal number of incremental advancements of the transfer conveyor 121, before full completion and tempering of a coil spring and delivery thereof takes place. However, during normal operation, one coil spring is completed for each incremental advancement of the transfer conveyor 121.

In the embodiment shown in FIG. 2, the control system 135 is operative to automatically and non-selectively cause energization of the conveyor drive servo-motor 155 through one operational cycle in response to completion of one operational cycle of both of the first and second main forming machine drive servo-motors 225 and 226 and is also operative to automatically and non-selectively cause simultaneous energization of the first and second forming machine drive servo-motors 225 and 226 in response to completion of one operational cycle of the conveyor drive servo-motor 155.

In this last regard, the transfer conveyor drive servo-motor 155 is serially and incrementally operated in response to serial completion of coil springs by the coil spring forming machines 113 and 115. In turn, the main forming machine drive servo-motors 225 and 226 of the coil spring forming machines 113 and 115 are actuated or energized to complete full formation, tempering, and delivery to the vertically extending pallets 161 in response to completion of each incremental advance of the transfer conveyor 121. Thus, every time the transfer conveyor 121 completes one incremental advancement, thereby locating one of the platens 161 in a vertical disposition in the loading station 153, the coil spring forming machines 113 and 115 are each energized so as to complete one coil spring and to deliver the completed coil spring to the vertically extending pallet 161 which is then at rest in the loading station 153.

Figure 16:
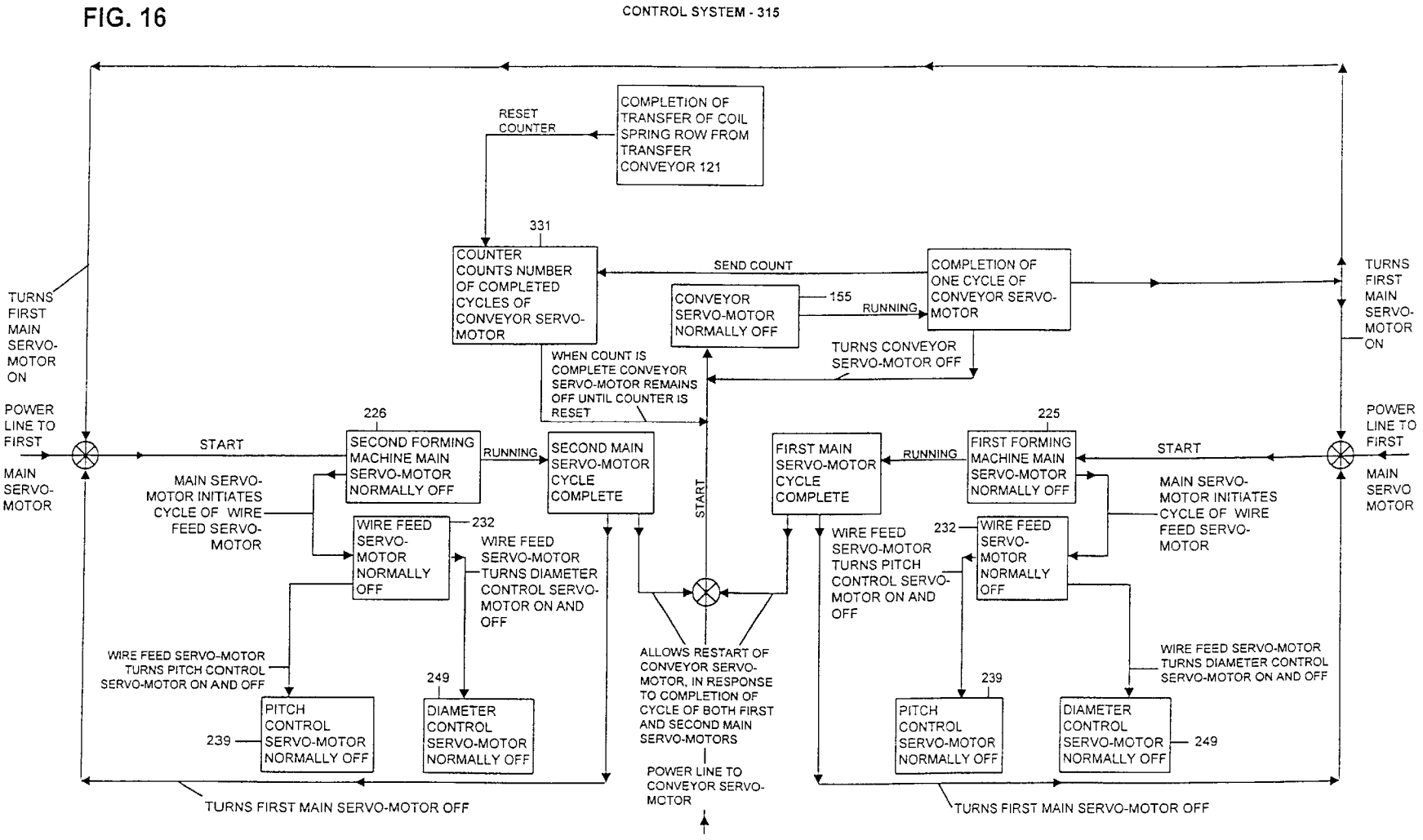
FIG. 16 is a diagrammatic view of one embodiment of a control system incorporated in the machine assembly shown in FIG. 2.

Still more specifically, FIG. 16 illustrates diagrammatically one embodiment of the control system 315. As depicted therein, the conveyor servo-motor 155 and the first and second main forming machine drive servo-motors 225 and 226 are normally off.

The conveyor drive servo-motor 155 can be initially energized by the operator, and thereafter, in response to completion of one operational cycle of the conveyor drive servo-motor 155, the conveyor drive servo-motor 155 is deenergized or turned off and remains turned off until completion of the next cycle of both of the first and second main forming machine servo-motors 225 and 226. In addition, completion of one operational cycle of the conveyor drive servo-motor 155 produces an energizing signal which is sent to both the first and second main forming machine servo-motors 225 and 226, whereby both servo-motors are energized or turned on. Thereafter, upon completion of one operational cycle of both of the first and second main forming machine servo-motors 225 and 226, the first and second forming machine drive servo-motors 225 and 226 are deenergized or turned off and remain turned off until completion of the next cycle of the conveyor drive servo-motor 155. In addition, completion of one operational cycle of both of the first and second main forming machine servo-motors 225 and 226, turns on or restarts the conveyor drive servo-motor 155.

Energization of the main forming machine drive servo-motors 225 and 226 serves also to derivatively energize the wire feed servo-motors 232 for an appropriate period of time to complete one cycle of the wire feed servo-motors 232. In turn, energization of the wire feed servo-motors 232 serves to energize, i.e., to turn on and off, the pitch control and diameter control servo-motors 239 and 249 for an appropriate period of time to complete one cycle of these servo-motors, all within the time period of one operational cycle of the main forming machine drive servo-motors 225 and 226.

The control system 315 also includes a first counter 331 which is adjustable to vary the count and which counts the number of completed operational cycles of the conveyor drive servo-motor 155, (or of one of the main forming machine drive servo-motors 225 and 226). When a predetermined count is reached, i.e., when the desired number of number of coil springs are located on the transfer conveyor 121 in a row adjacent the coil spring transfer apparatus 125, the counter 331 operates to prevent energization or turning on of the main forming machine servo-motors 225 and 226. However, when the transfer of a row of coil springs from the transfer conveyor 121 is completed, the counter 331 is signaled, i.e., is reset, and operates to thereafter permit energization of the main forming machine drive servo-motors 225 and 226. If the count is incomplete, the counter 331 permits the energization of, i.e., the initiation of the next cycle of, the wire feed servo-motors by the main forming machine servo-motors 225 and 226 so as to enable the wire feed servo-motors to feed another predetermined length of wire.

More specifically, in the control system shown in FIG. 16, each complete cycle of the conveyor servo-motor results in the sending of a signal to the counter 331 which, when the count is incomplete, permits initiation of the next cycle of the forming machine main servo-motors 225 and 226. When the count is complete, the counter 331 prevents the next initiation of the cycle of the conveyor servo-motor 155 until reset in response to completion of the transfer of a row of coil springs from the transfer conveyor 121 to the coil spring transfer apparatus 125.

Any suitable construction can be employed to provide the counter 331.

Figure 17:
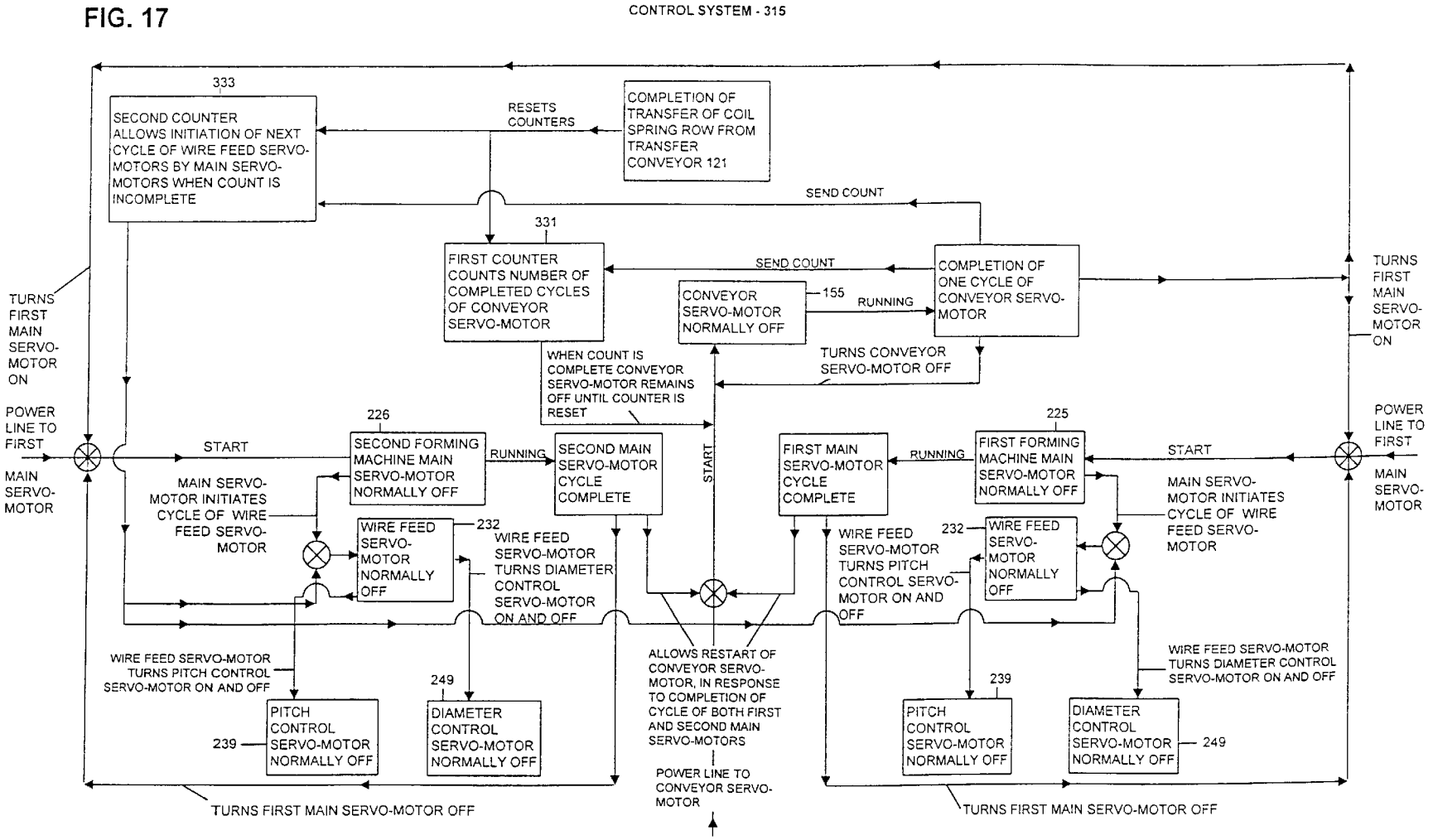
FIG. 17 is a diagrammatic view of a second embodiment of a control system incorporated in the machine assembly shown in FIG. 2.

FIG. 17 illustrates diagrammatically a second embodiment of the control system 315. As depicted therein, the control system 315 is the same as that shown in FIG. 16, except that an additional counter 333 also serves to control energization of, or initiation of the next cycle of, the wire feed servo-motors 232 by the forming machine main servo-motors 225 and 226, i.e., when the count at the counter 331 is incomplete, initiation of the next cycle of the wire feed servo-motors 232 by the forming machine main servo-motors 225 and 226 is allowed by the counter 331. When the count is complete, but the counter 331 has not been reset, energization of the wire feed servo-motors 232 by the forming machine main servo-motors 225 and 226 is prevented. After resetting of the counter 333, the counter 333 sends a signal permitting restarting of the conveyor servo-motor 155.

Any suitable construction can be employed to provide the counter 333.

As a consequence of the operation of the just-described embodiment of the control system 135, each energization of the main forming machine drive servo-motors 225 and 226 of the coil spring forming machines 113 and 115 is dependent on, and occurs only in response to, each succeeding incremental advancement of the transfer conveyor 121, and each energization of the conveyor drive servo-motor 155 (and consequent incremental advancement of the transfer conveyor 121) is dependent on, and occurs only in response to, each preceding completion of one coil spring by each of the coil spring forming machines 113 and 115.

The control system 135 also desirably includes one or more stop functions which is/are operable, in the event of a malfunction, such as the absence of a coil spring on one of the pallets 161 of the transfer conveyor 121, to disable further operation of the conveyor drive servo-motor 155 and the main forming machine drive servo-motors 225 and 226.

In operation of the machine assembly 111 as thus far disclosed, the conveyor drive servo-motor 155 is periodically and incrementally operated to move the transfer conveyor 121 through such distance as will locate the pallet 161 in a vertical orientation. Thereafter, and as a consequence of completion of the incremental movement of the transfer conveyor 121, the coil spring forming machines 113 and 115 are operated to respectively produce and deliver a coil spring to the vertically extending pallet 161. Thereafter, the conveyor drive servo-motor 155 is again energized to again advance the transfer conveyor 121 though the given incremental distance which is approximately equal to the length of the pallets 161 in the direction of conveyor advance.

In operation of the embodiment shown in FIG. 2, the machine assembly 111 is energized to cause each of the coil spring forming machines 113 and 115 to simultaneously deliver a coil spring to the one of the pallets 161 which is vertically extending during non-movement of the transfer conveyor 121. As a consequence, each pallet 161 receives two coil springs in side-by-side relation, and in slightly spaced relation in the direction of conveyor travel, with one of the coil springs desirably being of left-handed construction, and with the other of the coil springs desirably being of right-handed construction. If desired, both coil springs could be of the same hand.

In another embodiment which includes only a single coil spring forming machine which directly supplies fully formed coil springs to the transfer conveyor 121, i.e., the spring assembly machine 111 shown in FIG. 1 with only one coil spring forming machine, the control system 315 is operative to automatically and non-selectively cause energization of the conveyor drive servo-motor 155 in response to completion of one operational cycle of the main forming machine drive servo-motor 255, and, thereafter, is operative to automatically and non-selectively cause energization of the main forming machine drive servo-motor 225 in response to completion of one operational cycle of the conveyor drive servo-motor 155. Thereafter, completion of one operational cycle of the main forming machine drive servo-motor 225 causes energization of the conveyor drive servo-motor 155 to provide one incremental advance of the transfer conveyor 121, and so on.

Figure 6:
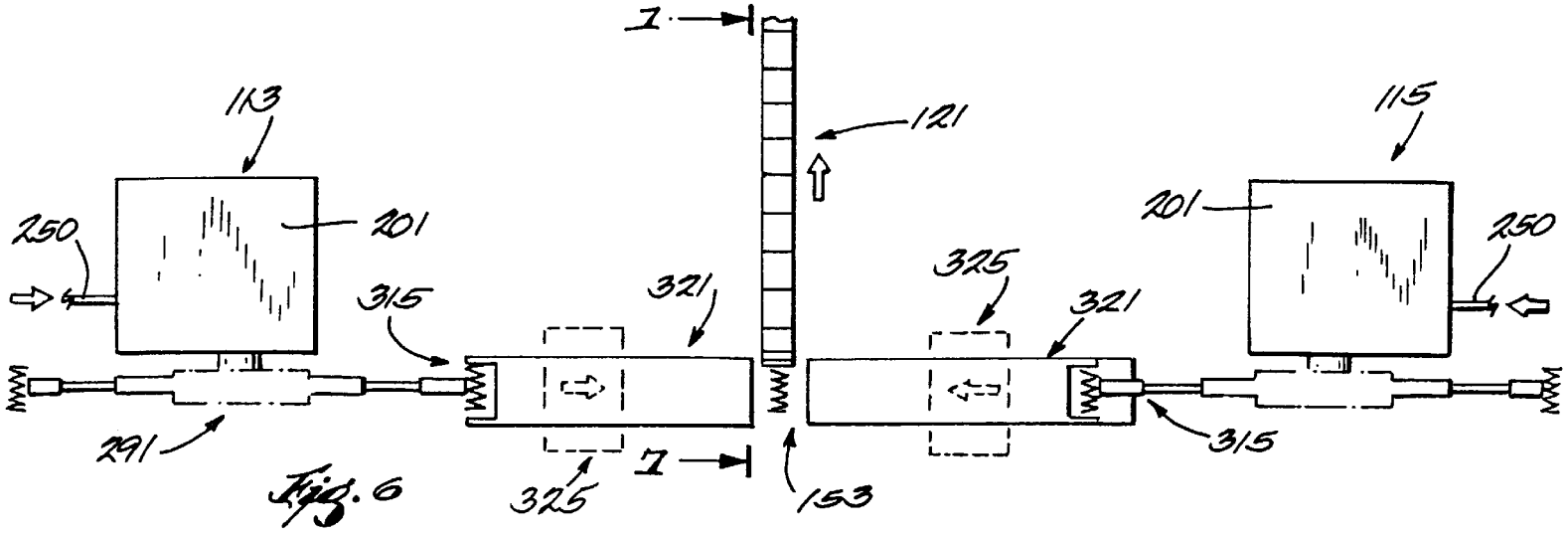
FIG. 6 is a top plan schematic view of a portion of a second embodiment of a coil spring forming and assembling machine which embodies various of the features of the invention.
Figure 18:
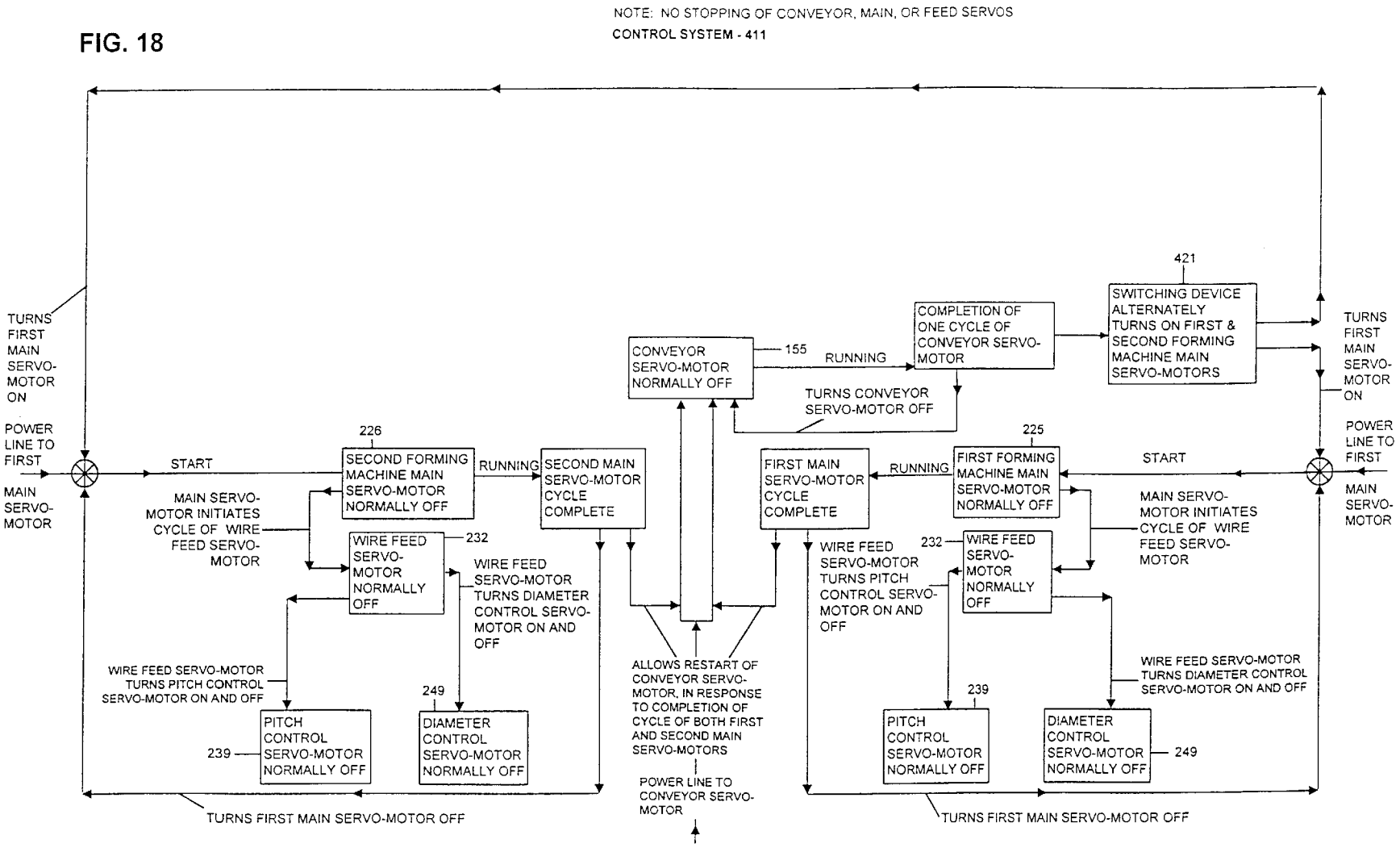
FIG. 18 is a diagrammatic view of one embodiment of a control system incorporated in the machine assembly shown in FIG. 6.

More particularly in the this regard, shown schematically in FIG. 18 is a control system 411 for the machine assembly shown in FIG. 6. The control system 411 is generally identical to the control system 315 shown in FIG. 16, except that the counter 331 is omitted, and except that the signal generated in response to completion of one cycle of the conveyor servo-motor 155 causes a switching device 421 to alternately energize the first and second main forming machine drive servo-motors 225 and 226. In addition, as distinguished from the control systems 315 shown in FIGS. 16 and 17, the conveyor servo-motor 155 can be energized by a signal from either of the forming machine main servo-motors 225 and 226. Thus, after completion of a first cycle of the conveyor drive servo-motor 155, one of the first servo-motors 225 and 226 is energized or turned on, while the other one of the forming machine drive servo-motors 225 and 226 remains deenergized, and then, after completion of the next cycle of the conveyer drive servo-motor 155, the other one of the servo-motors 225 and 226 is energized or turned on, while the first mentioned one of the servo-motors 225 and 226 remains deenergized.

Any suitable construction can be employed to provide the switching device 421.

In addition, the control system 411 of FIG. 18 differs from the control system 315 of FIG. 16 in that the power line to the conveyor drive servo-motor 155 includes first and second parallel branches 427 and 429 which are respectively connected to the lines which carry the signals indicating completion of the operational cycles of the first and second main forming machine drive servo-motors 225 and 226. Thus, whenever the operational cycle of one of the main forming machine drive servo-motors 225 and 226 is completed, the conveyor drive servo-motor 155 is again energized or turned on.

In the embodiment shown in FIG. 6, the control system 135 (a) is operative to automatically and non-selectively cause energization of the conveyor drive servo-motor through a first operational cycle in response to completion of one operational cycle of the second main forming machine drive servo-motor 226, (b) is operative to automatically and non-selectively cause energization of the first main forming machine drive servo-motor 225 in response to completion of the first operational cycle of the conveyor drive servo-motor 155, (c) is operative to automatically and non-selectively cause energization of the conveyor drive servo-motor 155 through a second operational cycle in response to completion of one operational cycle of the first main forming machine drive servo-motor 225, (d) is operative to automatically and non-selectively cause energization of the second main forming machine drive servo-motor 226 in response to completion of the second operational cycle of the conveyor drive servo-motor 155.

Thus, in operation of the embodiment shown in FIG. 6, the main forming machine drive servo-motors 225 and 226 are alternately energized to cause the coil spring forming machines 113 and 115 to alternately deliver completed coil springs to the transfer conveyor 121. More specifically, the machine assembly is arranged so that, initially, one of the coil forming machines 113 and 115 delivers one end convolution of a coil spring into the pocket 170 of one pallet 161 when the one pallet is located in vertically extending orientation in the loading station 153 during non-movement of the transfer conveyor 121. Thereafter, the transfer conveyor 121 is advanced through one increment of movement approximately equal to the length of one pallet 161 and so as to locate the next one of the pallets 161 in vertically extending orientation in the loading station 153. Thereafter, the other of the coil spring forming machines 113 and 115 delivers one end convolution of another coil spring (which is desirably of the other hand) into the pocket 170 of the next pallet 161 when the next pallet 161 is located in vertically extending orientation in the loading station 153 during non-movement of the transfer conveyor 121.

As a consequence, every other pallet 161 receives one coil spring which is desirably of a given hand, i.e., either left- or right-hand, while all of the intermediate pallets 161 receive one coil spring which, desirably, is of the other hand. However if desired, the coil forming machines 113 and 115 could be operated to deliver coils of the same hand to the transfer conveyor.

In another embodiment of the invention which is shown in FIG. 15 and which is otherwise similar to the arrangement shown in FIG. 6, the control system 315 is arranged to afford selective delivery by the coil spring forming machines 113 and 115 to the transfer conveyor 121. This capability permits the formation of coil spring rows (on the transfer conveyor 121) of a selected number of coil springs formed by one of the coil spring forming machines 113 and 115, followed by another selected number of coil springs formed by the other one of the coil spring forming machines 113 and 115. As a consequence, when one of the coil spring forming machines 113 and 115 manufactures coil springs of one selected configuration and the other of the coil spring forming machines 113 and 115 manufactures coil springs of another configuration, spring assemblies can be manufactured with predetermined variations in springiness.

More particularly, the control system 315 can be arranged to include first and second counting and switching devices 413 and 415 which are of any suitable construction, which are respectively connected to the main forming machine drive servo-motors 225 and 226 of the first and second coil spring forming machines 113 and 115, which are connectable to and disconnectable from the conveyor drive servo-motor 155 and which respectively include count adjusting knobs 423 and 425, whereby the number of coil springs to be delivered from either one of the first and second coil spring forming machines 113 and 115 to the transfer conveyor 121, before delivery of coil springs from the other one of the machines to the transfer conveyor 121, can be varied from 0 to X.

In the alternative, if desired, the first and second counting and switching devices 413 and 415 can be connected to the conveyor drive servo-motor 155 and can be respectively connectable to and disconnectable from the main forming machine drive servo-motors 225 and 226 of the first and second coil spring forming machines 113 and 115.

In operation of one embodiment, initially, the first and second counting and switching devices 413 and 415 are arranged so that the first counting and switching device 413 is connected to the conveyor drive servo-motor 155, and so that the second counting and switching device 415 is disconnected from the conveyor drive servo-motor 155. When thus arranged, and after manipulation of the adjusting knob 423 of the first counting and switching device 413 to select a desired number of successive operational cycles of the first coil spring forming machine 113, the arrangement is (a) thereafter operative to effect the selected desired number of successive operational cycles of the first coil spring forming machine 113 by successive energization of the main forming machine drive servo-motor 225 of the first coil spring forming machine 113 in response to each successive completion of the selected desired number of operational cycles of the conveyor drive servo-motor 155, and (b) thereafter, and upon completion of the selected desired number of operational cycles of the conveyor drive servo-motor 155, is operable to effect disconnection of the first counting and switching device 413 from the conveyor drive servo-motor 155 and connection of the second counting and switching device 415 to the conveyor drive servo-motor 155.

After such connection and disconnection, the second counting and switching device 415, and assuming that the adjusting knob 425 of the second counting and switching device 415 has been adjusted to select a desired number of successive operational cycles of the second coil spring forming machine 115, the arrangement is (a) thereafter operative to effect the selected desired number of successive operational cycles of the second coil spring forming machine 115 by successive energization of the main forming machine drive servo-motor 226 of the second coil spring forming machine 115 in response to each successive completion of the selected desired number of operational cycles of the conveyor drive servo-motor 155, and (b) thereafter, and upon completion of the selected desired number of operational cycles of the conveyor drive servo-motor 155, is operative to effect disconnection of the second counting and switching device 415 from the conveyor drive servo-motor 155 and re-connection of the first counting and switching device 413 to the conveyor drive servo-motor 155. Thereafter the first counting and switching device 413 operates as described just above.

Because it is believed that anyone skilled in the art can readily construct the control system 135 to obtain the operations disclosed above in detail, description of particular devices and components included in the control system 135 is believed to be unnecessary.

Various of the features of the invention are set forth in the following claims.

We claim:

1. A coil spring forming machine and transfer conveyor assembly comprising a transfer conveyor operable through a succession of operational cycles and including an endless conveyor assembly arranged for periodic travel along a predetermined path and through a coil spring loading station, and a conveyor servo-driving device drivingly connected to said conveyor assembly and operative, upon each energization thereof, to drive said conveyor assembly through one operational cycle thereof, a first coil spring forming machine located adjacent said predetermined path, operable through a succession of operational cycles to form coil springs, and, during a period of non-movement of said conveyor assembly, to load a coil spring on said conveyor assembly at said loading station, and including a first coil spring forming servo-driving device operative, upon each energization thereof, to drive said first coil spring forming machine through one operational cycle thereof, a second coil spring forming machine located adjacent said predetermined path, operable through a succession of operational cycles to form coil springs, and, during a period of non-movement of said conveyor assembly, to load a coil spring on said conveyor assembly at said loading station, and including a second coil spring forming servo-driving device operative, upon each energization thereof, to cause actuation of said second coil spring forming machine through one operational cycle thereof, and a control system operative to automatically and non-selectively cause energization of said conveyor servo-driving device in response to completion of one operational cycle of one of said first and second coil spring forming servo-driving devices, and operative to automatically and non-selectively cause energization of one of said first and second coil spring forming servo-driving devices in response to completion of one operational cycle of said conveyor servo-driving device.

2. An assembly in accordance with claim 1 wherein said control system operates to automatically and non-selectively cause energization of said conveyor servo-driving device in response to completion of one operational cycle of both of said first and second coil spring forming servo-driving devices, and operates to simultaneously energize said first and second coil spring forming servo-driving devices in response to completion of the same operational cycle of said conveyor servo-driving device.

3. An assembly in accordance with claim 1 wherein said control system operates to energize said first coil spring forming servo-driving device in response to completion of one of the operational cycles of said conveyor servo-driving device, and wherein said control system operates to energize said second coil spring forming servo-driving device in response to completion of the next one of the operational cycles of said conveyor servo-driving device.

4. An assembly in accordance with claim 1 wherein said servo-driving devices are servo-motors.

5. An assembly in accordance with claim 1 wherein said conveyor assembly includes a series of pallets which are pivotally connected, which, when located in said loading station, extend vertically, and which have a length which extends in the direction of conveyor assembly travel and which is approximately equal to a multiple of the diameter of the coil springs.

6. An assembly in accordance with claim 1 wherein said first coil spring forming machine also includes a first coil spring forming head which is periodically operative to at least partially form coil springs and which also includes a first wire feed advancing mechanism, a first wire feed servo-driving device drivingly connected to said first wire feed advancing mechanism and being operative in response to operation of said conveyor servo-driving device, a first pitch control tool, a first pitch control servo-driving device drivingly connected to said first pitch control tool and being operative in response to operation of said first wire feed servo-driving device, a first diameter control tool, and a first diameter control servo-driving device drivingly connected to said first diameter control tool and being operative in response to operation of said first wire feed servo-driving device, and wherein said second coil spring forming machine also includes a second coil spring forming head which is periodically operative to at least partially form coil springs and which includes a second wire feed advancing mechanism, a second wire feed servo-driving device drivingly connected to said second wire feed advancing mechanism and being operative in response to operation of said conveyor servo-driving device, a second pitch control tool, a second pitch control servo-driving device drivingly connected to said second pitch control tool and being operative in response to operation of said second wire feed servo-driving device, a second diameter control tool, and a second diameter control servo-driving device drivingly connected to said second diameter control tool and being operative in response to operation of said second wire feed servo-driving device.

7. An assembly in accordance with claim 1 wherein said first coil spring forming machine also includes a first coil spring forming head which is periodically operative to at least partially form a first coil spring having opposite ends, and a first coil spring completing and delivering mechanism operative to complete formation of the partially formed first coil spring and to deliver the completely formed first coil spring to said transfer conveyor, and including a first forming station including a first device for forming the opposite ends of the partially formed first coil spring to form a completely formed first coil spring, and a first tempering station including a first device for tempering the completely formed first coil spring, and wherein said second coil spring forming machine also includes a second coil spring forming head which is periodically operative to at least partially form a second coil spring having opposite ends, and a second coil spring completing and delivering mechanism operative to complete formation of the partially formed second coil spring and to deliver the completely formed second coil spring to said transfer conveyor, and including a second forming station including a second device for forming and/or locating the opposite ends of the partially formed second coil spring to form a completely formed second coil spring, and a second tempering station including a second device for tempering the completely formed second coil spring.

8. An assembly in accordance with claim 5 wherein said first and second coil spring forming machines simultaneously deliver fully completed coil springs to the one of said pallets which is located in said loading station.

9. An assembly in accordance with claim 5 wherein said first coil spring forming machine delivers a fully completed coil spring to the one of said pallets which is located in said loading station, and wherein said second coil spring forming machine delivers a fully completed coil spring to the next one of said pallets which is located in said loading station.

10. An assembly in accordance with claim 6 wherein said pitch control and said diameter control servo-driving devices are servo-motors.

11. An assembly in accordance with claim 7 wherein said first coil spring completing and delivering mechanism also includes a first coil transporting device for removing the first coil spring from the first coil spring forming head and for transporting the first coil spring through said first forming and tempering stations to said transfer conveyor, and wherein said second coil spring completing and delivering mechanism also includes a second coil transporting device for removing the second coil spring from the second coil spring forming head and for transporting the second coil spring through said second forming and tempering stations to said transfer conveyor.

12. A coil spring forming machine and transfer conveyor assembly comprising a transfer conveyor operable through a succession of operational cycles and including a single endless conveyor assembly arranged for periodic travel along a predetermined path and for passage through a coil spring loading station, and including a series of pallets which are successively located in said loading station incident to periodic travel of said conveyor assembly on said predetermined path, and a conveyor drive servo-motor drivingly connected to said conveyor assembly and operative, upon each energization thereof, to drive said conveyor assembly through one operational cycle thereof, a first coil spring forming machine located on one side of said predetermined path, operable through a succession of operational cycles to form a first coil spring, and, when one of said pallets is in said loading station and during a period of non-movement of said conveyor assembly, to load the first coil spring on said conveyor assembly in said loading station, and including a first coil spring forming servo-motor operative, upon each energization thereof, to drive said first coil spring forming machine through one operational cycle thereof, and a second coil spring forming machine located on the other side of said predetermined path, operable through a succession of operational cycles to form a second coil spring, and, when said one pallet is in said loading station and during a period of non-movement of said conveyor assembly, to load the second coil spring on said conveyor assembly in said loading station, and including a second coil spring forming servo-motor operative, upon each energization thereof, to drive said second coil spring forming machine through one operational cycle thereof, and a control system operative to automatically and non-selectively cause energization of said conveyor drive servo-motor through one operational cycle in response to completion of one operational cycle of both of said first and second coil spring forming servo-motors, and operative to automatically and non-selectively cause simultaneous energization of said first and second coil spring forming servo-motors in response to completion of one operational cycle of said conveyor drive servo-motor.

13. An assembly in accordance with claim 12 wherein said series of pallets are pivotally connected, extend vertically when located in said loading station, and have a length which extends in the direction of conveyor assembly travel and which is approximately equal to twice the diameter of the coil springs.

14. An assembly in accordance with claim 12 wherein said first coil spring forming machine also includes a first coil spring forming head which is periodically operative to at least partially form coil springs and which also includes a first wire feed advancing mechanism, a first wire feed servo-driving device drivingly connected to said first wire feed advancing mechanism and being operative in response to operation of said conveyor drive servo-motor, a first pitch control tool, a first pitch control servo-driving device drivingly connected to said first pitch control tool and being operative in response to operation of said first wire feed servo-driving device, a first diameter control tool, and a first diameter control servo-driving device drivingly connected to said first diameter control tool and being operative in response to operation of said first wire feed servo-driving device, and wherein said second coil spring forming machine also includes a second coil spring forming head which is periodically operative to at least partially form coil springs and which includes a second wire feed advancing mechanism, a second wire feed servo-driving device drivingly connected to said second wire feed advancing mechanism and being operative in response to operation of said conveyor drive servo-motor, a second pitch control tool, a second pitch control servo-driving device drivingly connected to said second pitch control tool and being operative in response to operation of said second wire feed servo-driving device, a second diameter control tool, and a second diameter control servo-driving device drivingly connected to said second diameter control tool and being operative in response to operation of said second wire feed servo-driving device.

15. A coil spring forming machine and transfer conveyor assembly comprising a transfer conveyor operable through a succession of operational cycles and including a single endless conveyor assembly arranged for periodic travel along a predetermined path and for passage through a coil spring loading station, and including a series of pallets which are successively located in said loading station incident to periodic travel of said conveyor assembly on said predetermined path, and which, when located in said loading station, extend vertically, and a conveyor drive servo-motor drivingly connected to said conveyor assembly and operative, upon each energization thereof, to drive said conveyor assembly through one operational cycle thereof, a first coil spring forming machine located on one side of said predetermined path, operable through a succession of operational cycles to form a first coil spring, and, when one of said pallets is in said loading station and during a period of non-movement of said conveyor assembly, to load said first coil spring on said conveyor assembly in said loading station, and including a first coil spring forming servo-motor operative, upon each energization thereof, to drive said first coil spring forming machine through one operational cycle thereof, a second coil spring forming machine located on the other side of said predetermined path, operable through a succession of operational cycles to form a second coil spring, and, when said one pallet is in said loading station and during a period of non-movement of said conveyor assembly, to load said second coil spring on said conveyor assembly in said loading station, and including a second coil spring forming servo-motor operative, upon each energization thereof, to drive said second coil spring forming machine through one operational cycle thereof, and a control system operative to automatically and non-selectively cause energization of said conveyor drive servo-motor through a first operational cycle in response to completion of one operational cycle of said first coil spring forming servo-motor, operative to automatically and non-selectively cause energization of said second coil spring forming servo-motor in response to completion of said first operational cycle of said conveyor drive servo-motor, operative to automatically and non-selectively cause energization of said conveyor drive servo-motor through a second operational cycle in response to completion of one operational cycle of said second coil spring forming servo-motor, and operative to automatically and non-selectively cause energization of said first coil spring forming servo-motor in response to completion of said second operational cycle of said conveyor drive servo-motor.

16. An assembly in accordance with claim 15 wherein said first coil spring forming machine also includes a first coil spring forming head which is periodically operative to at least partially form coil springs and which also includes a first wire feed advancing mechanism, a first wire feed servo-driving device drivingly connected to said first wire feed advancing mechanism and being operative in response to operation of said conveyor drive servo-motor, a first pitch control tool, a first pitch control servo-driving device drivingly connected to said first pitch control tool and being operative in response to operation of said first wire feed servo-driving device, a first diameter control tool, and a first diameter control servo-driving device drivingly connected to said first diameter control tool and being operative in response to operation of said first wire feed servo-driving device, and wherein said second coil spring forming machine also includes a second coil spring forming head which is periodically operative to at least partially form coil springs and which includes a second wire feed advancing mechanism, a second wire feed servo-driving device drivingly connected to said second wire feed advancing mechanism and being operative in response to operation of said conveyor drive servo-motor, a second pitch control tool, a second pitch control servo-driving device drivingly connected to said second pitch control tool and being operative in response to operation of said second wire feed servo-driving device, a second diameter control tool, and a second diameter control servo-driving device drivingly connected to said second diameter control tool and being operative in response to operation of said second wire feed servo-driving device.

17. A coil spring forming machine and transfer conveyor assembly comprising a transfer conveyor operable through a succession of operational cycles and including an endless conveyor assembly arranged for periodic travel along a predetermined path and through a coil spring loading station and including a plurality of pivotally connected pallets each having a length which extends in the direction of conveyor assembly travel and which is approximately equal to a multiple of the diameter of the coil springs, and a conveyor drive servo-motor drivingly connected to said conveyor assembly and operative, upon each energization thereof, to drive said conveyor assembly through one operational cycle thereof, a coil spring forming machine located adjacent said predetermined path, operable through a succession of operational cycles to form a first coil spring, and, during a period of non-movement of said conveyor assembly, to load the first coil spring on said transfer conveyor, and including a coil spring forming servo-motor operative, upon each energization thereof, to drive said coil spring forming machine through one operational cycle thereof, and a control system operative to automatically and non-selectively cause energization of said conveyor drive servo-motor in response to completion of one operational cycle of said coil spring forming servo-motor, and, thereafter operative to automatically and non-selectively cause energization of said coil spring forming servo-motor in response to completion of one operational cycle of said conveyor drive servo-motor.

18. An assembly in accordance with claim 17 wherein said coil spring forming machine also includes a coil spring forming head which is periodically operative to at least partially form coil springs and which also includes a wire feed advancing mechanism, a wire feed servo-driving device drivingly connected to said wire feed advancing mechanism and being operative in response to operation of said conveyor drive servo-motor, a pitch control tool, a pitch control servo-driving device drivingly connected to said pitch control tool and being operative in response to operation of said wire feed servo-driving device, a diameter control tool, and a diameter control servo-driving device drivingly connected to said diameter control tool and being operative in response to operation of said wire feed servo-driving device.

19. A coil spring forming machine and transfer conveyor assembly comprising a transfer conveyor operable through a succession of operational cycles and including an endless conveyor assembly arranged for periodic travel along a predetermined path and through a coil spring loading station, and a conveyor drive servo-motor drivingly connected to said conveyor assembly and operative, upon each energization thereof, to drive said conveyor assembly through one operational cycle thereof, a first coil spring forming machine located adjacent said predetermined path, operable through a succession of operational cycles to form coil springs, and, during a period of non-movement of said conveyor assembly, to load a coil spring on said transfer conveyor, and including a first coil spring forming servo-motor operative, upon each energization thereof, to drive said first coil spring forming machine through one operational cycle thereof, a second coil spring forming machine located adjacent said predetermined path, operable through a succession of operational cycles to form coil springs, and, during a period of non-movement of said conveyor assembly, to load a coil spring on said transfer conveyor, and including a second coil spring forming servo-motor operative, upon each energization thereof, to drive said second coil spring forming machine through one operational cycle thereof, and a control system including first and second counting and switching devices which are respectively connected to one of (a) said conveyor drive servo-motor, and (b) said first and second coil spring forming servo-motors, and which are respectively connectable to and disconnectable from the other of (a) said conveyor drive servo-motor, and (b) said first and second coil spring forming servo-motors, said first counting and switching device being adjustable to select a desired number of successive operational cycles of said first coil spring forming machine, being operable to effect said selected desired number of successive operational cycles of said first coil spring forming machine by successive energization of said first coil spring forming servo-motor in response to each successive completion of said selected desired number of operational cycles of said conveyor drive servo-motor, being operable, upon completion of said selected desired number of operational cycles of said conveyor drive servo-motor, to cause disconnection of said conveyor drive servo-motor and said first counting and switching device and connection of said conveyor drive servo-motor and said second counting and switching device, and said second counting and switching device being adjustable to select a desired number of successive operational cycles of said second coil spring forming machine, being operable to effect said selected desired number of successive operational cycles of said second coil spring forming machine by successive energization of said second coil spring forming servo-motor in response to each successive completion of said selected desired number of operational cycles of said conveyor drive servo-motor, being operable, upon completion of said selected desired number of operational cycles of said conveyor drive servo-motor, to cause disconnection of said conveyor drive servo-motor and said second counting and switching device and connection of said conveyor drive servo-motor and said first counting and switching device.

20. An assembly in accordance with claim 19 wherein said first coil spring forming machine also includes a first coil spring forming head which is periodically operative to at least partially form coil springs and which also includes a first wire feed advancing mechanism, a first wire feed servo-driving device drivingly connected to said first wire feed advancing mechanism and being operative in response to operation of said conveyor drive servo-motor, a first pitch control tool, a first pitch control servo-driving device drivingly connected to said first pitch control tool and being operative in response to operation of said first wire feed servo-driving device, a first diameter control tool, and a first diameter control servo-driving device drivingly connected to said first diameter control tool and being operative in response to operation of said first wire feed servo-driving device, and wherein said second coil spring forming machine also includes a second coil spring forming head which is periodically operative to at least partially form coil springs and which includes a second wire feed advancing mechanism, a second wire feed servo-driving device drivingly connected to said second wire feed advancing mechanism and being operative in response to operation of said conveyor drive servo-motor, a second pitch control tool, a second pitch control servo-driving device drivingly connected to said second pitch control tool and being operative in response to operation of said second wire feed servo-driving device, a second diameter control tool, and a second diameter control servo-driving device drivingly connected to said second diameter control tool and being operative in response to operation of said second wire feed servo-driving device.

* * * * *